US005829938A

United States Patent [19]

Hartwig et al.

[11] Patent Number: 5,829,938

[45] Date of Patent: Nov. 3, 1998

[54] DESKTOP BOOK BINDER HAVING MEANS FOR ALIGNING SHEETS TO BE BOUND WITH A PREFORMED BINDING MATERIAL AND METHOD

[75] Inventors: Frederic W. Hartwig, Rolling Hills; Harold P. Hocking, Manhattan Beach, both of Calif.

[73] Assignee: Advanced Hi-Tech Corporation, El Segundo, Calif.

[21] Appl. No.: 815,157

[22] Filed: Mar. 11, 1997

Related U.S. Application Data

[63] Continuation-in-part of Ser. No. 615,719, Mar. 13, 1996.

[51] Int. Cl.[6] ..... B42C 9/00

[52] U.S. Cl. ..... 412/8; 412/6; 412/36

[58] Field of Search ..... 412/33, 34, 36, 412/37, 41, 900, 901, 902, 1, 6, 3, 8; 281/15.1, 21.1, 23, 28; 156/349, 216, 217, 211

[56] References Cited

U.S. PATENT DOCUMENTS 4,129,471 12/1978 Rome ..... 281/21.1

4,141,100 2/1979 Domroe et al. ..... 412/37

4,441,950 4/1984 Lolli ..... 281/21.1

OTHER PUBLICATIONS

Jacobs Gardner Office Supply Catalog, p. 444, item (A) Laser/Copier Labels, Dec. 1990.

*Primary Examiner*—Willmon Fridie, Jr.

*Attorney, Agent, or Firm*—Irving Kesechner

[57] ABSTRACT

A simplified desktop book binder method and apparatus wherein the sheets to be bound are accurately aligned by the binder tape itself. In particular, the conventional binder tape is formed into an L-shape. Alignment is achieved since the inside corner of the L and the edge of the bundle of sheets of paper are in contact. The tape is dropped into a correspondingly shaped slot in the binder apparatus and the paper bundle is placed on top of the tape, the edge of the bundle being automatically aligned against the corner of the tape. The free end of the long leg is wrapped tightly around the paper bundle. In an alternative arrangement, a form is substituted for the bundle of paper, the form being covered with non-stick tape. Since the glue will not adhere to the tape, the form may be removed after binding leaving the covers and binding tape with glue inside the spine, thus allowing the user to make folders as desired.

15 Claims, 18 Drawing Sheets

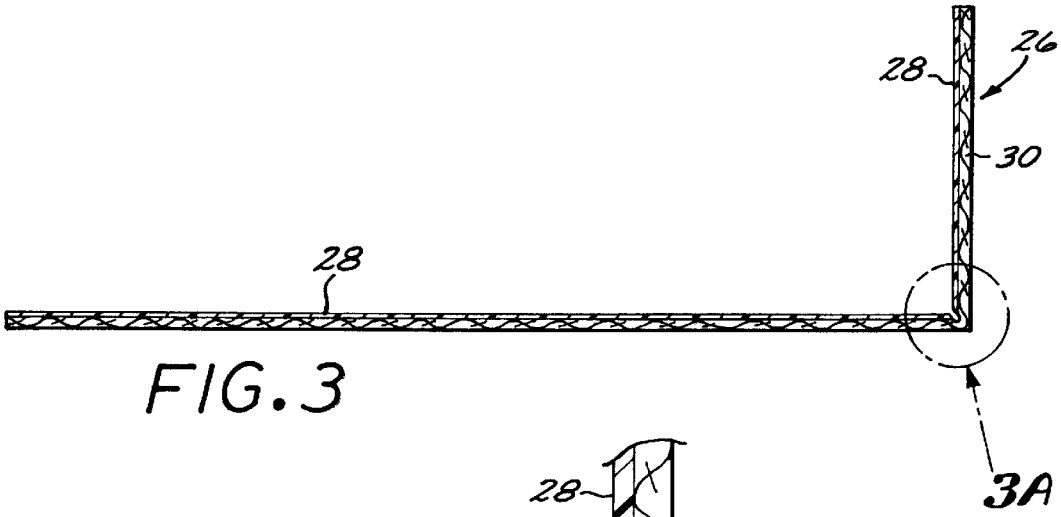
FIG. 3
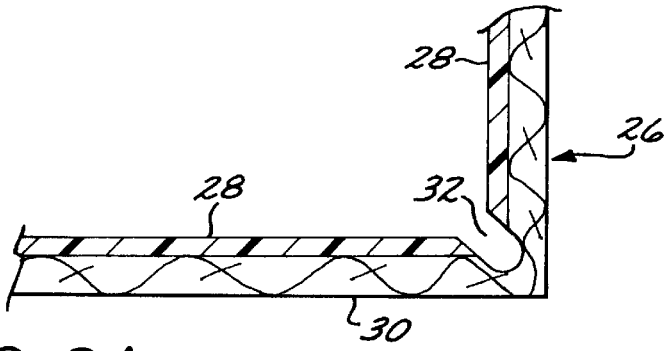
FIG. 3A
FIG. 4
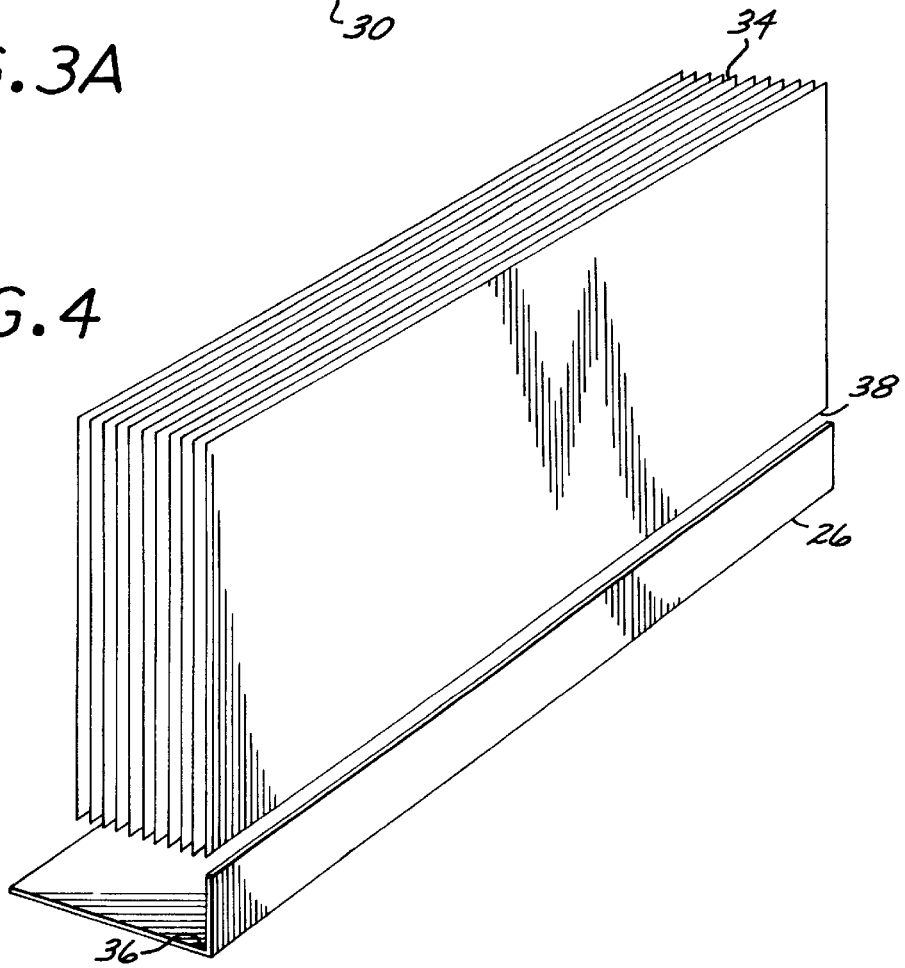

DESKTOP BOOK BINDER HAVING MEANS FOR ALIGNING SHEETS TO BE BOUND WITH A PREFORMED BINDING MATERIAL AND METHOD

RELATED APPLICATIONS

This application is a continuation-in-part application of U.S. application Ser. No. 08/615,719, filed Mar. 13, 1996.

BACKGROUND OF THE INVENTION

1. Field of the Invention

The present invention relates to a desktop book binder for binding loose sheets of paper into a book and wherein means are provided for aligning the sheets of paper with binding material which has been formed into an L-shape.

2. Description of the Prior Art

Many techniques have evolved over the past centuries for binding loose sheets of paper into a book. One such teaching uses tapes coated with hot-melt glue and wrap-around folders having hot-melt glue on the inside of their spine. In this method, the tape or folder is wrapped around the edges of the bundle of papers to be bound and the glue is heated. The glue adheres to the paper, the binding process being completed when the glue cools.

A major problem with this method is the accurate alignment of the tape with the edges of the paper. Sophisticated solutions capture both the paper and tape which are brought into alignment using sensors and automated precision mechanisms. This solution is expensive. Another method that may achieve alignment is by preforming the tape's cross section into a U-shape. The paper is placed inside the U and the combination is heated for binding. Because the width of the U is fixed, many different tape sizes must be stocked.

With respect to the folder binding, paper is dropped into the folder and the combination then heated to melt the glue to complete the binding. Like the preformed U-shaped tapes, the widths of the folders are fixed so the user must stock many sizes, thus increasing costs since folders are expensive.

Examples of various binding techniques are disclosed in the following U.S. patents. U.S. Pat. No. 4,129,471 to Rome discloses a system wherein a cover folder has an adhesive material in the backbone area; U.S. Pat. No. 3,717,366 to Decker discloses a system wherein an adhesive material is applied to the inside of a folded book cover and a device to fold the book cover; U.S. Pat. No. 3,321,786 to Bollick, Jr. discloses a book binding apparatus wherein a platform is provided for stacking the paper to be bound, a rise element for clamping the stacked edge of paper together, a device for applying an adhesive to the stacked edge of paper and means for heating the adhesive material for a predetermined period of time; U.S. Pat. No. 4,496,617 to Parker discloses an improved binding strip for binding a stack of sheets together; and U.S. Pat. No. 3,757,736 to Anderson discloses a bookbinder apparatus wherein pages are clamped in a carriage and edges aligned by a vibrator in a first angular position, the carriage rotated for a preheating stage, hot-melt glue applied to the edges and the bound papers then moved to a cooling position.

Printing on thermal binding tapes is also difficult both because the tapes are difficult to align with a printer and because they are not compatible with printer feeding mechanisms. After binding, specialized spine printers are available but they typically print only on the spine and print only in black and white, and are limited to the dimensions of the area they can cover. In addition, when only a few books are thermally bound at time, professional spine printing is prohibitively expensive. When printing books on demand or in an office environment, the number of books is usually limited. In these cases, after thermal binding, the spine is left blank. This is both annoying and inconvenient. What is thus desired is to provide a binding apparatus which is simple and inexpensive wherein both sheets and folders are easily bound in the apparatus and wherein the binding tapes can be easily printed simply and economically before the binding tapes are inserted into the apparatus even if only a few books are bound at a time.

SUMMARY OF THE PRESENT INVENTION

The present invention provides a simplified desktop book binder method and apparatus wherein the sheets to be bound are accurately aligned by the binder tape itself and wherein the preformed binder tape also enables various thickness books to be bound. In particular, conventional binder tapes are formed into an L-shape. Alignment is achieved since the inside corner of the L and the edge of the bundle of sheets of paper fit together exactly. The long leg of the L-shape is oriented horizontally.

The tape is dropped into a correspondingly shaped slot in the binder apparatus and the paper bundle is placed on top of the tape, the edge of the bundle being automatically aligned against the corner of the tape. The free end of the long leg of the L-shape tape can be wrapped tightly around the paper bundle, thus handling variations in bundle thickness.

In an alternative arrangement, instead of binding a bundle of papers between covers, a form whose shape resembles that of a slat is substituted for the bundle of paper. The form is covered with Teflon tape (Teflon is a registered trademark of E. I. Dupont de Nemours Corporation, Wilmington, Del., for a synthetic resin polymer). Since the glue will not adhere to the Teflon, the form may be removed after binding. This leaves the covers and binding tape with glue inside the spine. Thus, the user may make his/her own folders, only the number and width needed at the moment required to be made. The covers used to make the folders then can be printed on using conventional printers before the sheet binding procedure is initiated. Thus, flexibility is enhanced and cost is greatly reduced as well.

Prior to bending into the desired preformed L-shape, the tapes are flat. In another option, they are assembled side-by-side to form a sheet, the sheet being held together by a backing of release paper. The sheet can be passed through an ordinary desktop printer wherein text, labels, title, logos, images, bar-codes, etc. can be printed in color or black and white on the sheet of tapes. The tapes, once printed, can then be peeled off of the sheet. The L-shaped bend is made manually along a pre-scored line in the tape, the preprinted tape now being ready for binding. Still another option is to provide a sheet of release paper with only a narrow strip of release adhesive. A single tape can be flattened manually and applied, glue layer down, to the narrow release adhesive strip. The combination can now be passed through a printer. By this method, single tapes may be printed upon by an ordinary desk top printer. After printing, the tape is striped off the sheet of release paper. The tape is manually rebent into the L-shape and is used for binding. The sheet of paper with the strip of release adhesive may be reused several times until the release adhesive strip will no longer adhere to a tape. The assembly of one or more tapes into sheets enables preprinting of the tapes on the user's own printer.

The tape with the L-shaped bend is inserted into a slot formed in the top of the binder apparatus. The corner of the bend in the tape is aligned with the bottom corner or edge of the slot. The paper bundle is then inserted on top of the tape. The user then depresses a lever on one end of the binder apparatus to initiate the process. The binding process consists of clamping the paper bundle and binding tape together in proper alignment, wrapping the binding material around the paper bundle, melting the glue so that it adheres to the edges of the sheets of paper in the bundle, and allowing the assembled document to cool. After a cooling period, the operator depresses a lever on the other end of the binder apparatus to release the bound document and reset the binder apparatus for the binding sequence.

The unique L-shaped tape enables easy, accurate alignment with the paper bundle, thereby simplifying the binder apparatus design. The binder apparatus, as will be explained in more detail hereinafter, includes a movable platen, clamping stop, and bender a configuration which assures tight accurate folding of the tape around the paper bundle.

The heaters used to melt the tape glue have a very small thermal mass, direct heating of the tape or folder thus eliminating any warm-up requirement. The heaters include a thermal insulator enabling a fast glue-heating cycle balanced with a rapid cool-down requirement. Preheating of the binding tape assures gentle handling of fragile documents during tape bending. Controlled heating of the binding tape allows glue of a substantially uniform thickness to be applied to the tape in contradistinction to the non-uniform glue thickness of many prior art binder tapes, reducing the cost of the binding tapes and thus of the binding process.

The tapes used in the present invention can be assembled into sheets enabling preprinting of the tapes on the user's own printer, selection of appropriate tape widths when assembled in sheet form allowing the operator to use standard label making software and avoid unprintable areas along the edges of most printers.

A removable Teflon coated form may be used to replace the paper during binding, thus enabling the user to make and customize binding folders for later use.

The present invention thus provides a simple binder apparatus which provides a number of user desired features at a relatively inexpensive cost.

BRIEF DESCRIPTION OF THE DRAWING

For a better understanding of the invention, as well as other objects and further features thereof, reference is made to the following description which is to be read in conjunction with the accompanying drawing wherein:

FIG. 3 is a cross-sectional view along line 3—3 of FIG. 2;

FIG. 3A is a detail of FIG. 3;

FIG. 4 is a simplified perspective view of a bundle of sheets of paper positioned relative to the L-shaped binding tape;

DESCRIPTION OF THE INVENTION

Figure 1:
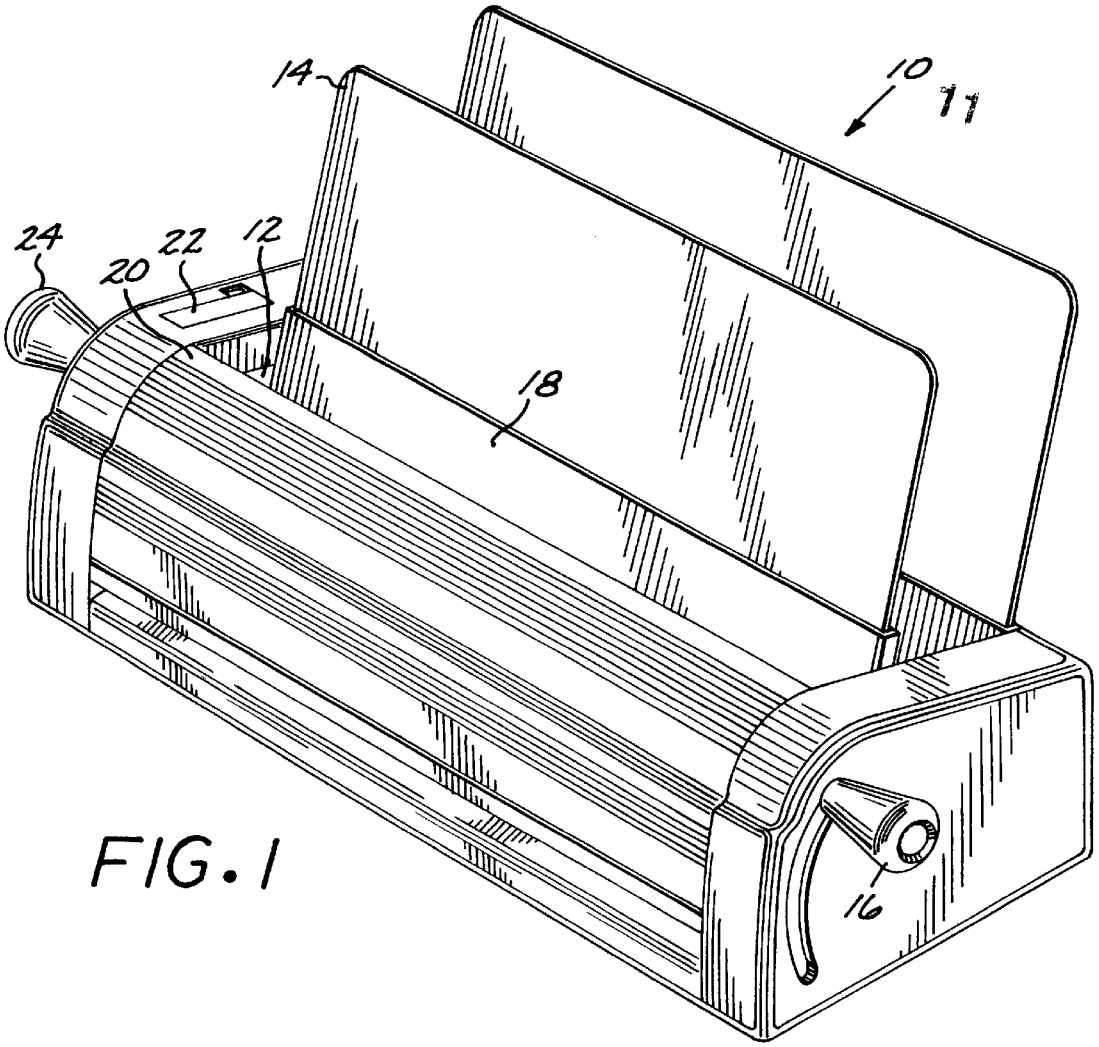
FIG. 1 is a perspective view of the binder apparatus of the present invention.
Figure 2:
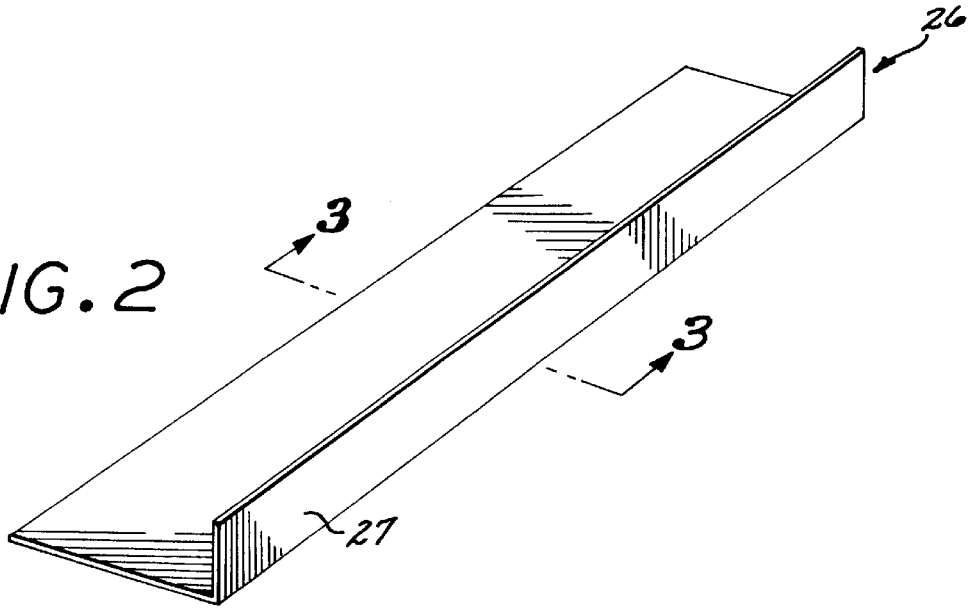
FIG. 2 is a perspective view of the binding tape of the present invention having an L-shaped bend.

Referring now to FIG. 1, a perspective view of the binding apparatus 10 of the present invention is illustrated. The material to be bound is inserted into slot 12, the material being held upright by book rest 14.

As will be set forth hereinafter, when right hand handle, or lever, 16 is pulled down, platen 18 is moved forward together with the material to be bound. When the clamping stop 20 is reached the motion stops. Further pressure on lever 16 closes a switch which initiates the binding operation. Binding activity is indicated by the illumination of LED light 22, completion of the binding activity being indicated when the light is extinguished. The left hand handle 24 is then pulled down to release the bound book and reset the mechanism for the next binding operation.

The material to be bound consists of a bundle of sheets of paper 34 (FIG. 4), an optional front cover and back cover, and binding tape 26. Alternatively, a folder with glue on its spine may be used for binding. In accordance with the teachings of the present invention, binding tape 26 is folded into an L-shape, leg 27 of tape 26 providing the alignment reference for the paper sheets 34.

The binding tapes preferably are made of paper or cloth coated on one side with a substantially uniform thickness layer of hot-melt glue. The tapes are cut into strips of several widths and lengths. The user of the device thus has a choice of tapes from which one will best fit the document to be bound is selected.

A more detailed cross-section of the tape is shown in FIG. 3 and illustrates hot-melt glue layer 28. When melted, the glue flows onto the edges of the sheets of paper in the paper bundle. When cooled, it binds together the sheets of paper, the tape, and the covers. Paper or cloth 30 is utilized in conjunction with binding tape 26 and provides strength to the spine after binding. A score line 32 is formed on tape 26 during manufacturing to create the prefolded alignment corner 36 as shown in FIG. 4. The score line 32 facilitates bending and to insure that the bend line is straight, is parallel to, and is a proper uniform distance from the edge of the tape. The paper bundle 34 and the binding tape 26 are in proper orientation prior to binding, the alignment edge 38 of the paper bundle 34 being inserted into the prefolded alignment corner 36 when inserted through slot 12 of binder apparatus 10.

Typically characteristics of binding tape 26 are as follows:

Thickness of layer 28: 8 mils

Thickness of paper layer 30: 5 mils

Thickness of cloth layer 30: 10 mils

Melting properties of layer 30: 240° F. to about 260° F.

An adhesive material which has been utilized successfully is the Ecomelt® F1-Ex 416 hot melt adhesive available from Collano Inc., Paramount, Calif.

Figure 5:
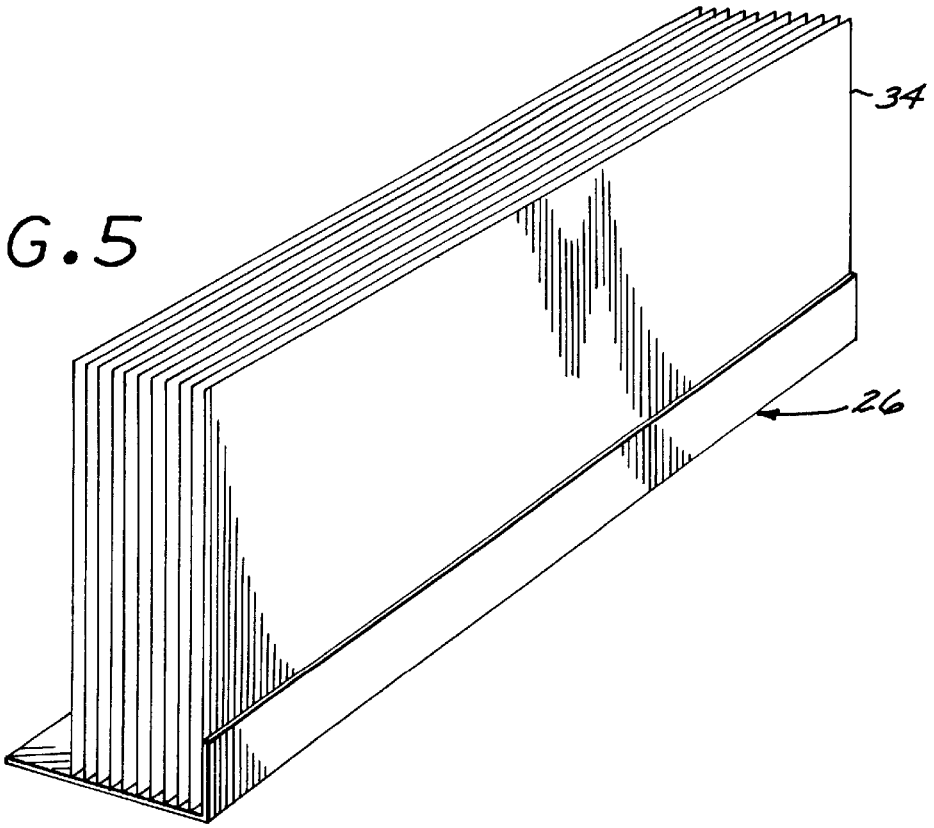
FIG. 5 is a perspective view of the paper bundle seated properly on the L-shaped binding tape.
Figure 6:
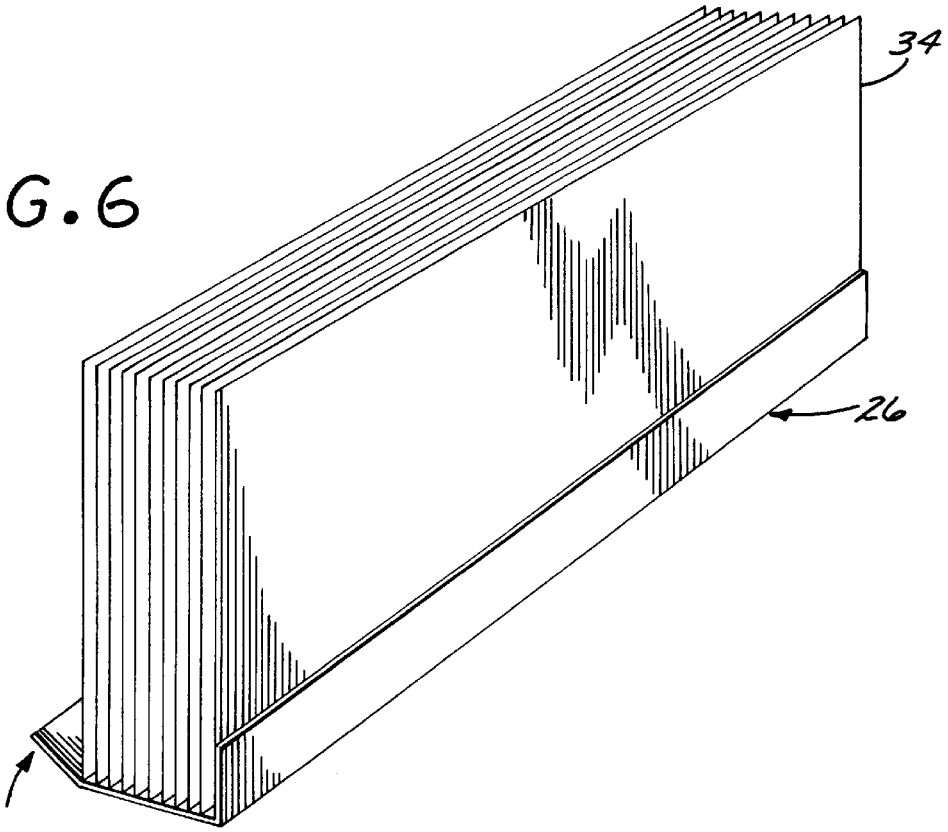
FIG. 6 is similar to FIG. 5 with bending of the tape partially completed.
Figure 7:
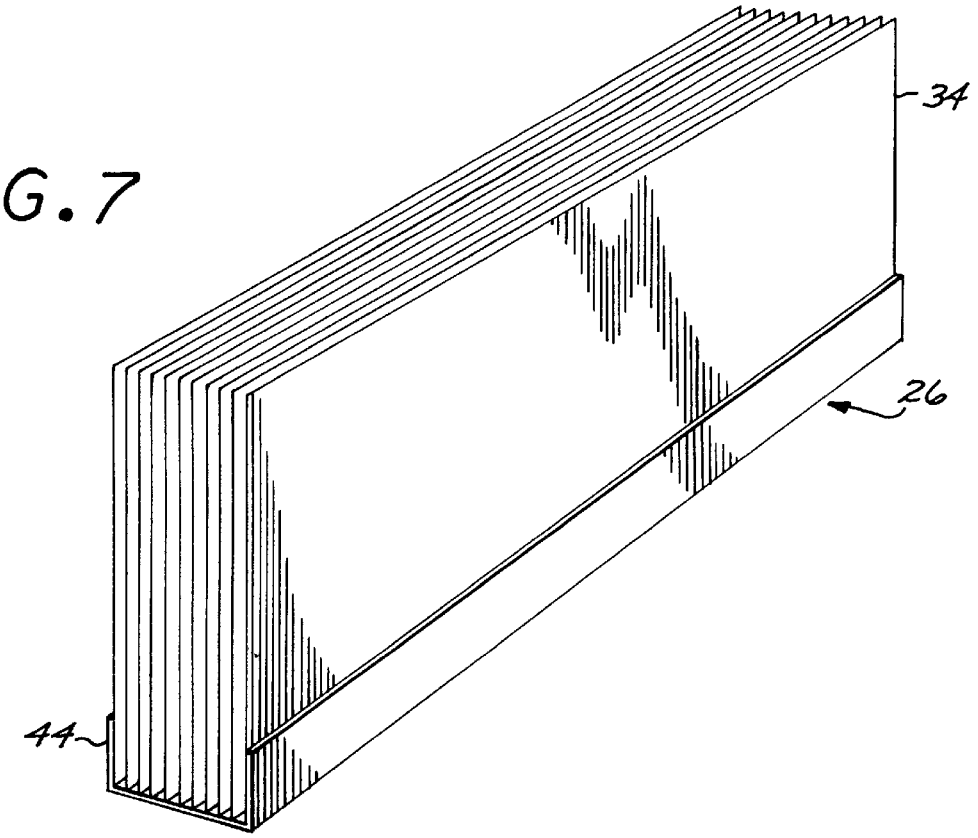
FIG. 7 is similar to FIG. 6 with the bending completed.

FIG. 5 illustrates the paper bundle 34 properly inserted into the binding tape 26, FIG. 6 shows the partial folding of the binding tape 26 around the paper bundle 34 and FIG. 7 shows the completed wrapping of the binding tape 26 around the paper bundle 34, numeral 44 representing the final fold.

Figure 8:
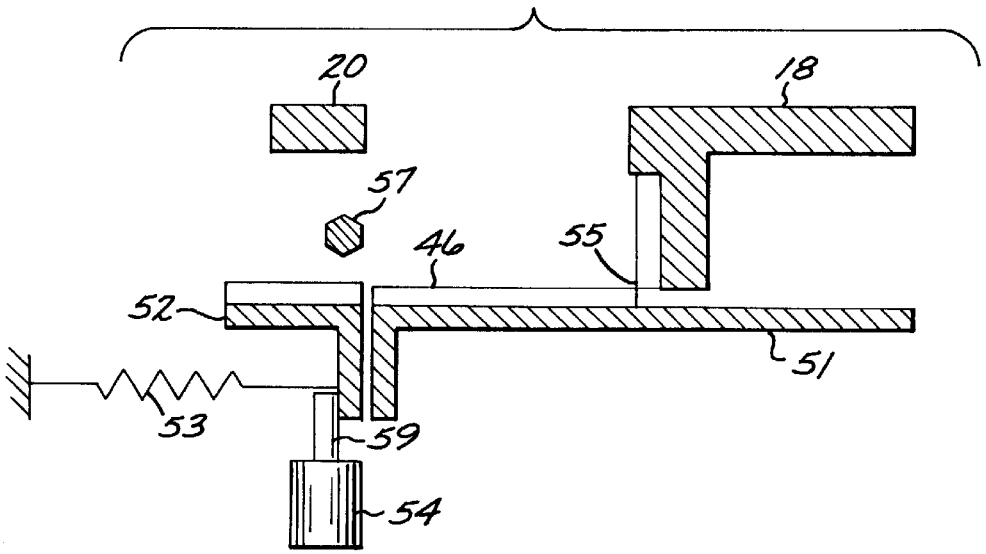
FIG. 8 is a simplified cross-sectional view of the cavity in the binder apparatus of the present invention into which the tape and paper bundle are inserted and aligned.

FIG. 8 illustrates a simplified cross-section of the binder apparatus 10 and shows the clamping stop 20, movable platen 18, spine foil heater 46, bender heater 48, platen heater 50, base structure 51, pivoting bender 52, bender pivot spring 53 and solenoid 54 which restrains and then releases the pivoting bender 52 and compressor bar 57. The alignment corner 36 of the binding tape 26 is inserted and aligned in the bottom alignment corner 55.

Figure 9:
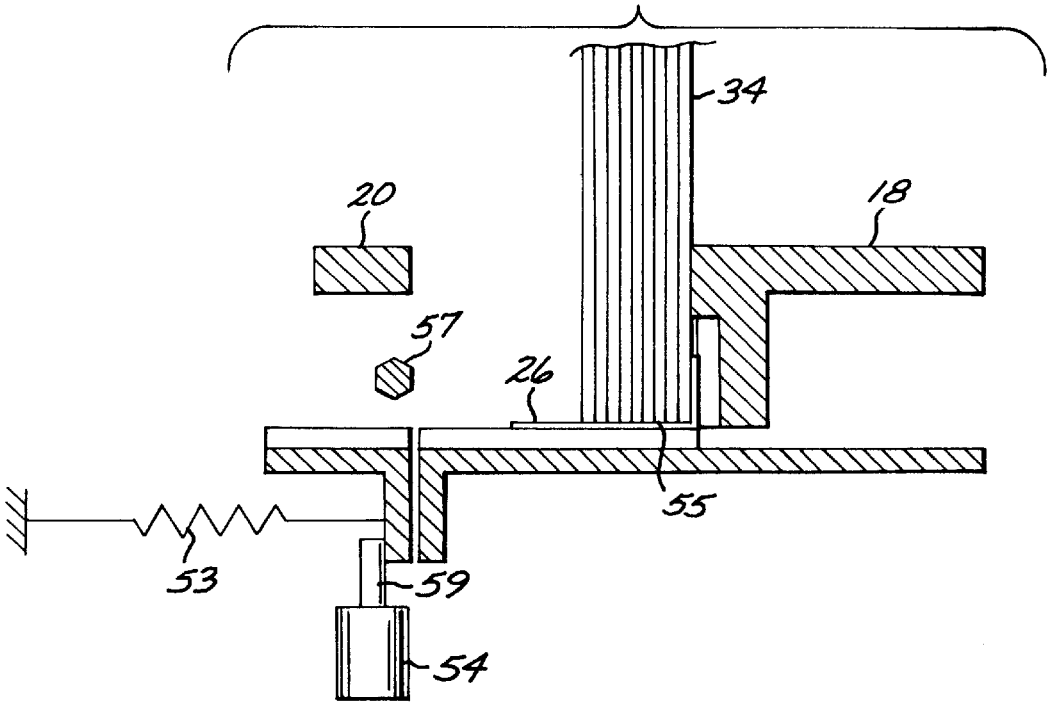
FIG. 9 is similar to FIG. 8 but with the tape and bundle of paper inserted properly.

FIG. 9 illustrates the same elements as are shown in FIG. 8 with the addition of the binding tape 26 and the paper bundle 34 shown in the properly aligned position.

Accurate alignment of the loose binding tape 26 and the edge of the paper bundle 34 to be bound is essential. Therefore, the binder cavity 12 into which the tape and paper are inserted has a sharp right angle corner along one edge in the bottom between the bottom and the platen 18, referred to as the bottom alignment corner 55.

The binding tape 26 is manually aligned against bottom alignment corner 55 as illustrated. The sheets of paper 34 to be bound sit on top and in the L-shaped corner of the tape 26. The binder apparatus 10 is then closed, the tape being ready to be clamped, heated, and wrapped around the other unbound edge of the bundle of paper.

Since the book to be bound may vary in thickness from a few pages up to several inches, the position of the unbound edge of the paper bundle 34 is unknown.

Figure 10:
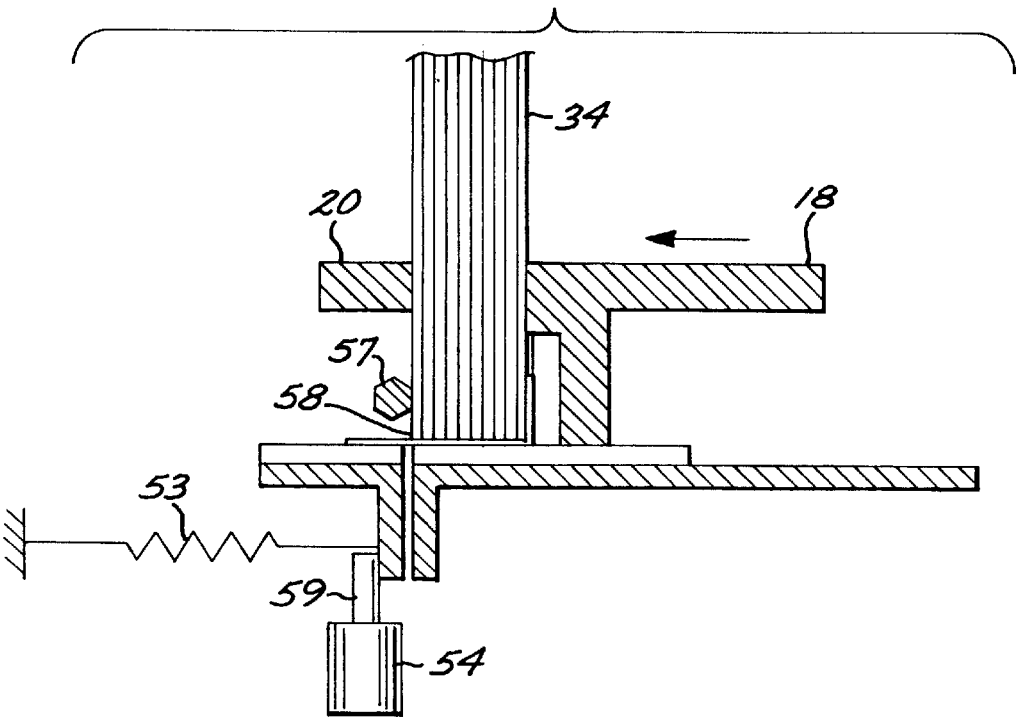
FIG. 10 illustrates the binder slot after the platen has moved to clamp the tape and paper bundle against the clamping stop the proper position for binding.

Therefore, as shown in FIG. 10, the paper bundle 34 and binding tape 26 are clamped together and fixed in position relative to each other as together they are pressed against clamping stop 20 within the binder apparatus 10. The clamping stop 20 is located precisely so that the second bending of the tape occurs exactly at the open unbound edge 58 of the paper bundle 34. This assures a very tight wrap of the tape around the paper bundle 34.

When the right handle 16 on the binder apparatus 10 is depressed, the platen 18 moves carrying with it the binding tape 26 and the paper bundle 34. Thus, the paper bundle is clamped against the clamping stop 20. The binder apparatus 10 is now ready to heat the binding tape 26 and wrap it around the paper bundle 34.

Figure 11:
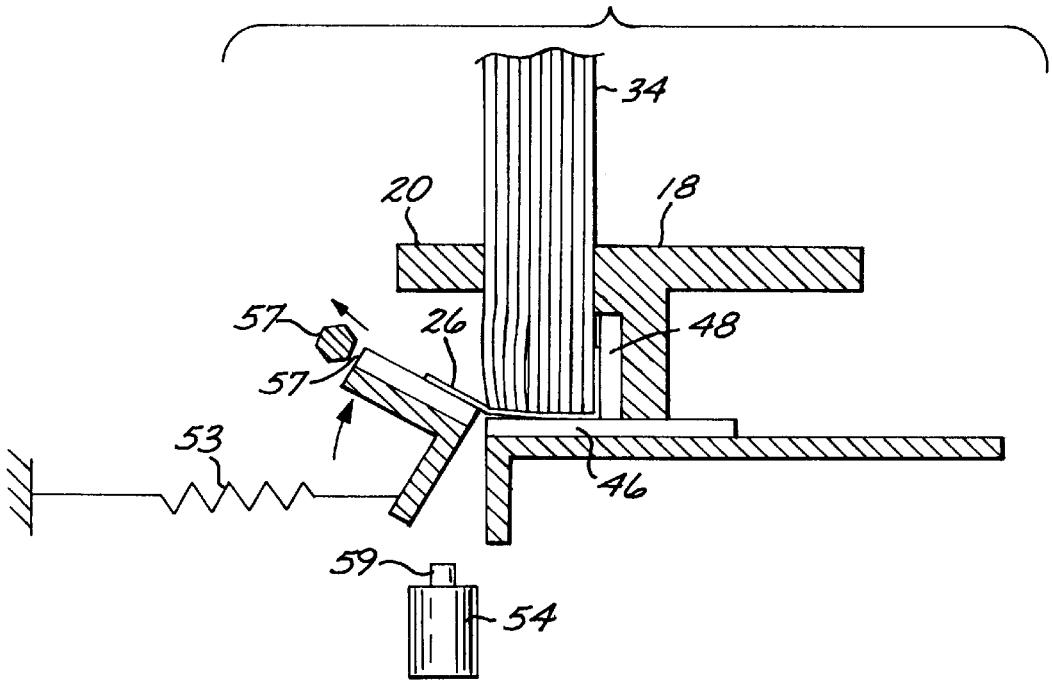
FIG. 11 is a simplified cross-sectional view of the binder apparatus of the present invention illustrating the mechanisms, the tape and paper sheets during the binding cycle.

FIG. 11 illustrates plunger 59 of solenoid 54 retracted after a predetermined heating time period, the bending motion of the pivoting bender 52 thus being initiated. In the case when the binding tape 26 is at room temperature, the melt, or glue 28, layer makes the binding tape 26 somewhat stiff. It has no score line at the free, or far end, of the binding tape 26 to weaken the tape and assist bending because the exact location of the bend was not predictable beforehand. If pressure is applied to the binding tape 26 to try and force a bend, that pressure will be transferred to the paper bundle 34. If the paper bundle 34 is thin and weak, the pressure on the paper bundle 34 may cause the bundle's shape to buckle and be deformed.

If the binding tape 26 is fully heated before bending, layer 28 will not be contained and may run off and contaminate the inside of the binder apparatus 10.

Therefore, heating of the binding tape 26 is started before bending starts. When the melt layer 28 becomes soft but not runny approximately 15 seconds after the paper bundle is clamped against stop 20, pressure is then applied to the binding tape 26 to begin the wrapping process.

Therefore, there is a delay in the release of the solenoid 54. During this delay, the heaters are allowed to preheat the binding tape 26. This preheating softens the melt layer 28 and makes the binding tape 26 very pliable.

If a constant voltage is applied to the foil heaters 57, the rise in temperature per unit time is fairly predictable. The time when the glue 28 will be soft can be inferred and the wrapping can be begun at that time using a simple timer. Alternatively, the temperature can be measured.

The binder apparatus 10 is designed to operate on. either 110 volts or 220 volts with no operator intervention. At 220 volts, the temperature rise will be much faster that a simple timer will not accurately predict the time when the melt layer softening occurs.

Therefore, the current flow is measured instead, current flow being proportional to the resistance of the foil heaters resistance which varies linearly with the temperature thereof. When the heaters reaches a certain temperature regardless of the magnitude of the voltage used to bring it to that temperature, it can be safely inferred that the melt layer 28 is soft and that the wrapping operation can begin. This start of the bending operation is activated by the release of the solenoid 54 after a time period related to the time it takes to heat the melt layer to the point that the wrapping operation begins (approximately 15 seconds as noted hereinabove). The heater timing parameters are based upon the melting profile of melt layer 28. The tape is now bent by the binder and wrapped around the sheet in the paper bundle 34 to form a bound book. The binding tape 26 cross-section is now U-shaped. A timer allows the book to cool until the melt layer 28 has hardened enough to allow removal of the book.

Figure 12:
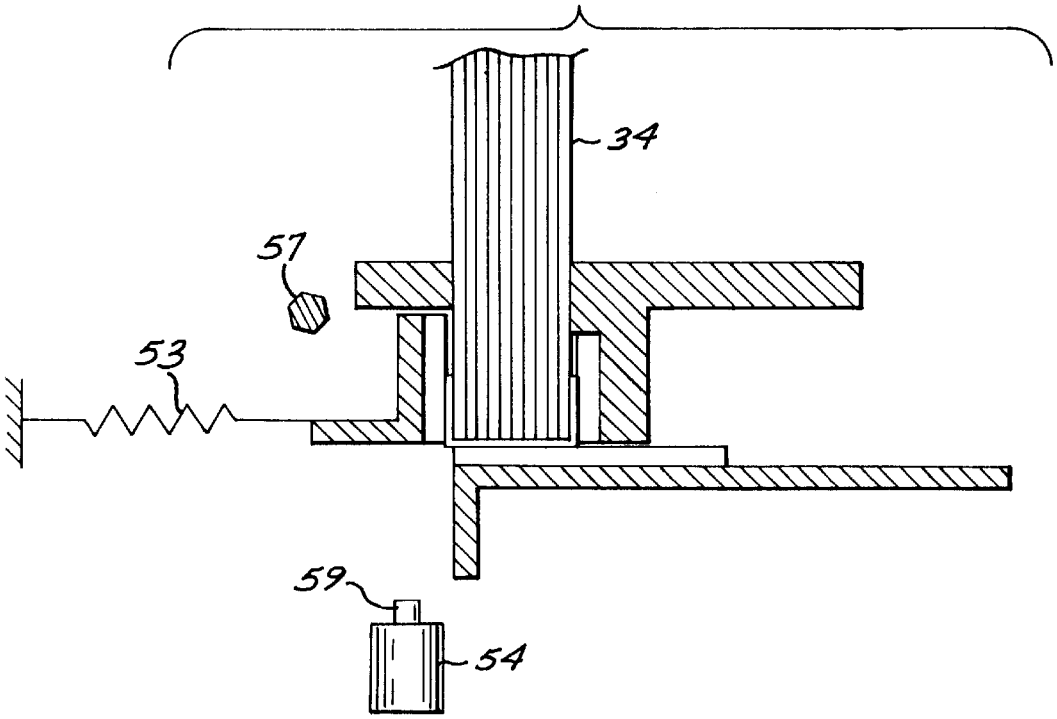
FIG. 12 is a simplified cross-sectional view of the binder apparatus of the present invention showing the mechanisms, the tape, and the paper bundle following completion of the binding operation.

FIG. 12 shows the binder elements in the final position during binding. After the light emitting diode light 22 goes out, the left handle 24 may be depressed to release the bound document and reset the binder 10 for the next binding operation.

Figure 13:
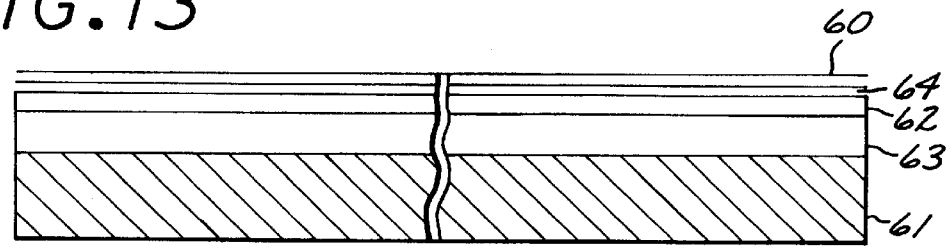
FIG. 13 is a cross-sectional view of the heater assembly utilized in the present invention.

FIG. 13 shows the cross-section of a typical heater assembly 57. The first or top layer 60 comprises Teflon which prevents transfer of ink from preprinted tapes to the heater during binding. Tapes which were preprinted on a laser type printer have a toner type ink which is fixed by thermal fusing. When these tapes are used in the hot environment of the binder, the toner ink tends to soften and will partially transfer to the heater surface. Over time, this contamination is very undesirable.

Therefore, the outer surface of each heater is coated with a very thin layer of Teflon tape to which the toner ink will not adhere. Other materials such as special silicones which will perform the same function can be used instead of Teflon. It should be noted, however, to avoid these problems it is preferred that an ink jet printer be utilized.

Layer 50 comprises aluminum to prevent physical damage and to more evenly distribute heat. Foil heater 56, is preferably made of a printed circuit board or two insulating layers between which are embedded closely spaced resistive conductors or wires.

The heaters emit heat from both their top and bottom surfaces However, the metallic supporting structure would absorb too much of the emitted heat if thermal access were allowed, yet thermal access is desirable during the cooling period following binding. Therefore, an insulating layer 63 is provided. The thermal conductivity of this layer is chosen to avoid loss of heat to the supporting structure during binding and yet allow cooling after binding is finished. Layer 64 is the structural base.

Figure 14:
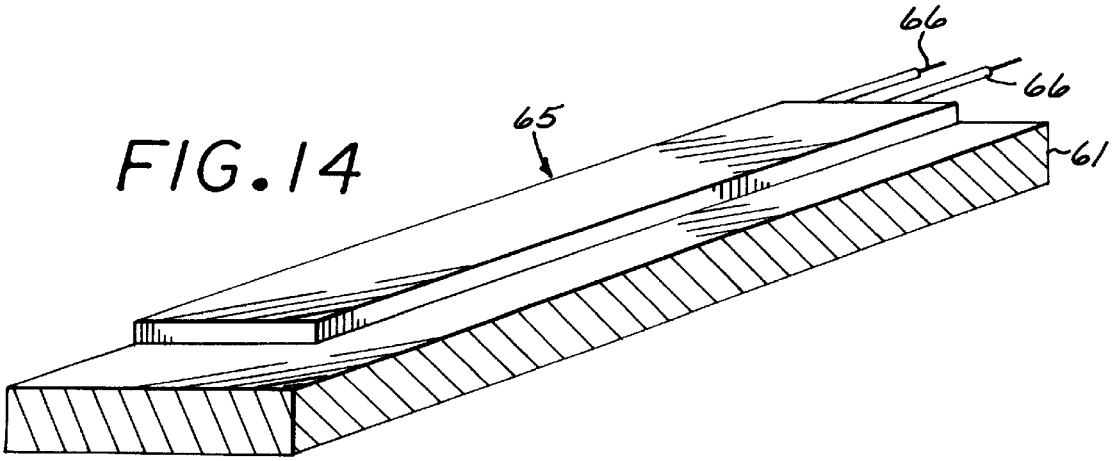
FIG. 14 is a perspective view of a heater assembly utilized in the present invention.

A perspective view of a heater assembly 65 is shown in FIG. 14. Also shown are the heater wires 66.

Many users prefer the convenience of complete folders into which they place their loose sheets for binding. Once the loose sheets are dropped into the folder, the entire package may be inserted into the binder where the glue is heated and binding takes place.

The drawback is that individual binders are expensive because they are preprinted at professional print shops whereat minimum order quantities are very expensive.

Figure 15:
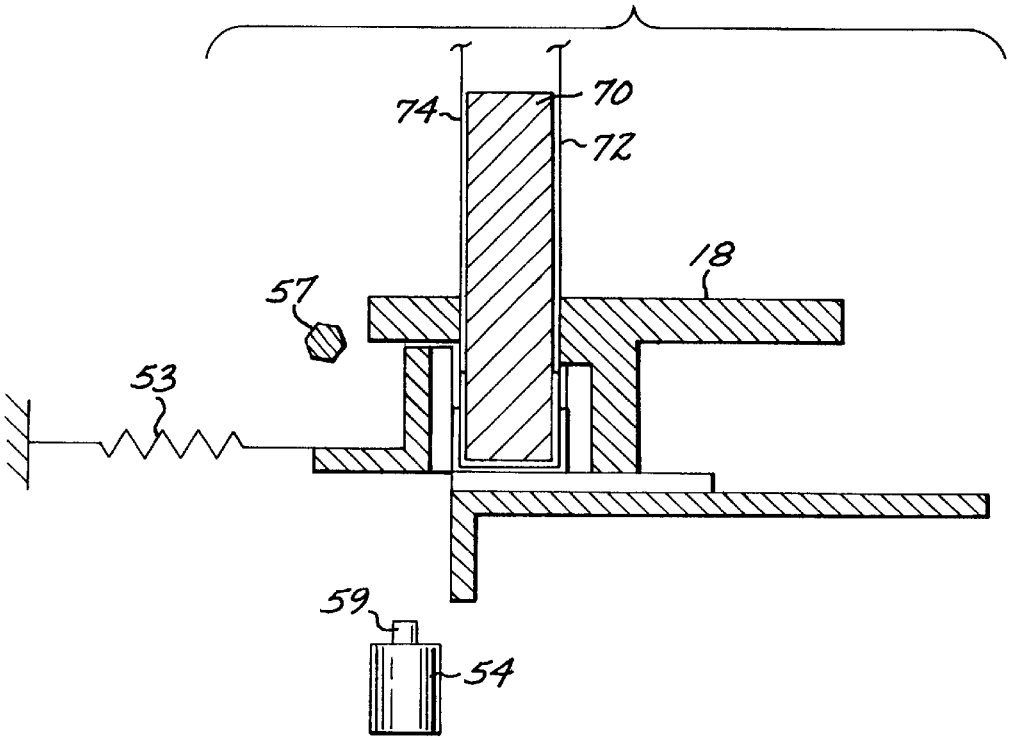
FIG. 15 is a simplified cross-sectional view of a completed binding operation similar to the view shown in FIG. 12 but where a removable Teflon coated form has been substituted for the paper bundle in order to make a folder for later use in binding.

FIG. 15 shows an arrangement for making folders inexpensively.

The folders are made in exactly the same way a stack of loose sheets would be bound into a book. However, the sheets are replaced during binding with a reusable Teflon coated removable form 70. When binding is completed, the form is removed easily since the glue or adhesive will not adhere to the Teflon. The result is a folder of the proper width with glue on its spine. This folder will then accept sheets of paper and may be bound in the binder apparatus in the normal fashion.

A front cover 72 and a back cover 74 must be used. The result is a folder complete with a layer of glue or adhesive along the inside of its spine. The covers 72 and 74 and the binding tape 26 may be preprinted prior to making the folder. The printing can be customized and accomplished less expensively by using the operator's own printer and customizing the folder width to exactly match the binding requirement.

Therefore, by providing the user with matching tapes and cover stock, the user can make folders at a fraction of the cost of customized binding folders currently on the market. The user needs to make in advance only the number expected to be used thereby reducing inventory costs. Customized printing can be accomplished on the cover more directly applicable to the contents of the moment.

Figure 16:
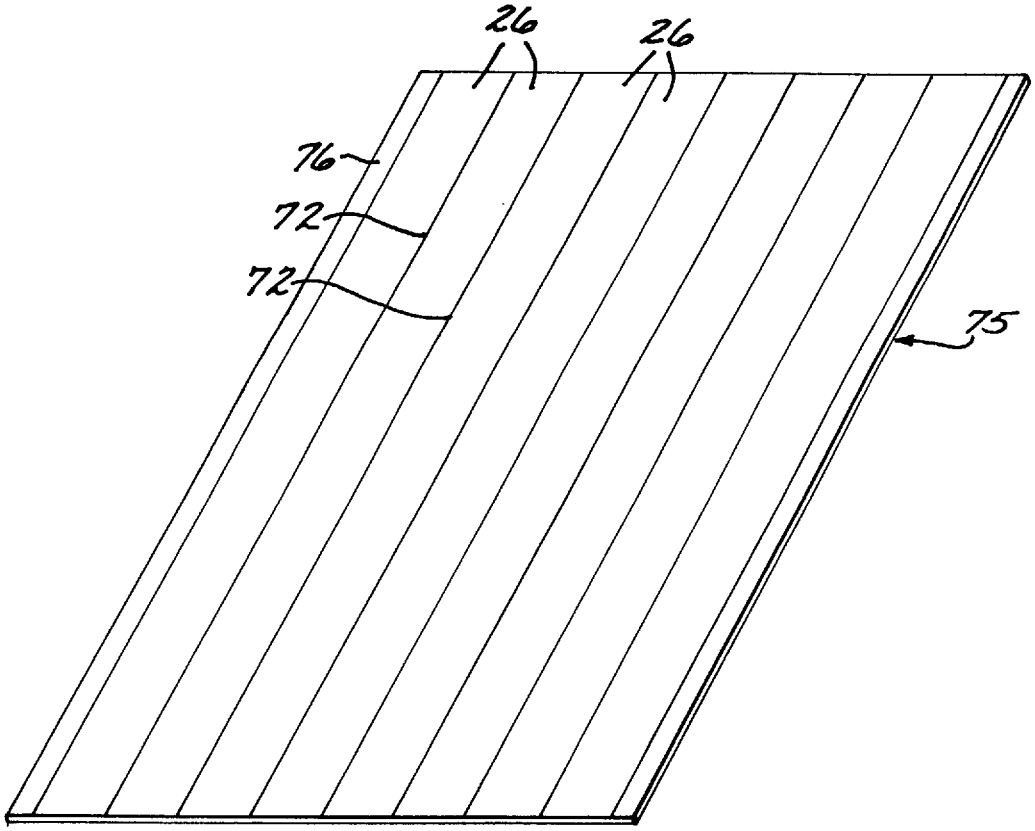
FIG. 16 illustrates an arrangement of the binding tapes on release paper to produce a sheet which can be inserted in a desktop printer for custom preprinting prior to folding and binding.

FIG. 16 shows a perspective view of a tape sheet 75 consisting of binding tapes 26 arranged side by side to form a sheet. As shown, it is ready to be printed in a desktop printer.

Figure 17:
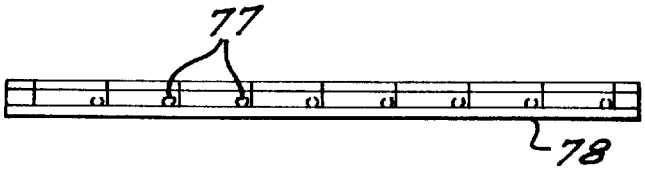
FIG. 17 is a cross-sectional view of the tape sheet shown in FIG. 16.

The user designs the printing desired to be placed on the tape sheets whether this be a background color, pattern, text, image, logo, price, or bar-code. A label making software program is adequate. However, most printers will not print on the outer ¼ inch (reference numeral 76) along the edges of a sheet of paper. Therefore, tapes are manufactured, according to the teachings of the invention, in a process whereby a roll of pre-glued paper wider than 8.5 inches is provided. The glue side is scored at locations corresponding to where the tapes are expect to be bent. The glue side is then covered with a release paper. The entire sandwich is trimmed to 8.5 inches wide while the paper on the tape side is kiss cut along lines 77 to form the tapes. The paper 30 and glue 28 are kiss cut down to but not including the release paper 78 (FIG. 17). The final operation is to cut the roll of sheet tapes to the proper length. The width of the area which is kiss cut to form the tapes is limited to 8.0 inches to leave ¼ inch boundaries to accommodate the unprintable edge areas of most printers. Other dimensions are possible including sheet sizes used in Europe.

FIG. 17 shows a cross-section of a tape sheet 75. There is shown a scored line 77 on each individual binding tape 26. This permits the user to peel off the individual binding tapes 26 and manually fold them into the required L-shaped cross-section. The tapes are stripped off the release paper 78, bent by hand at the score line, and used normally.

Figure 18:
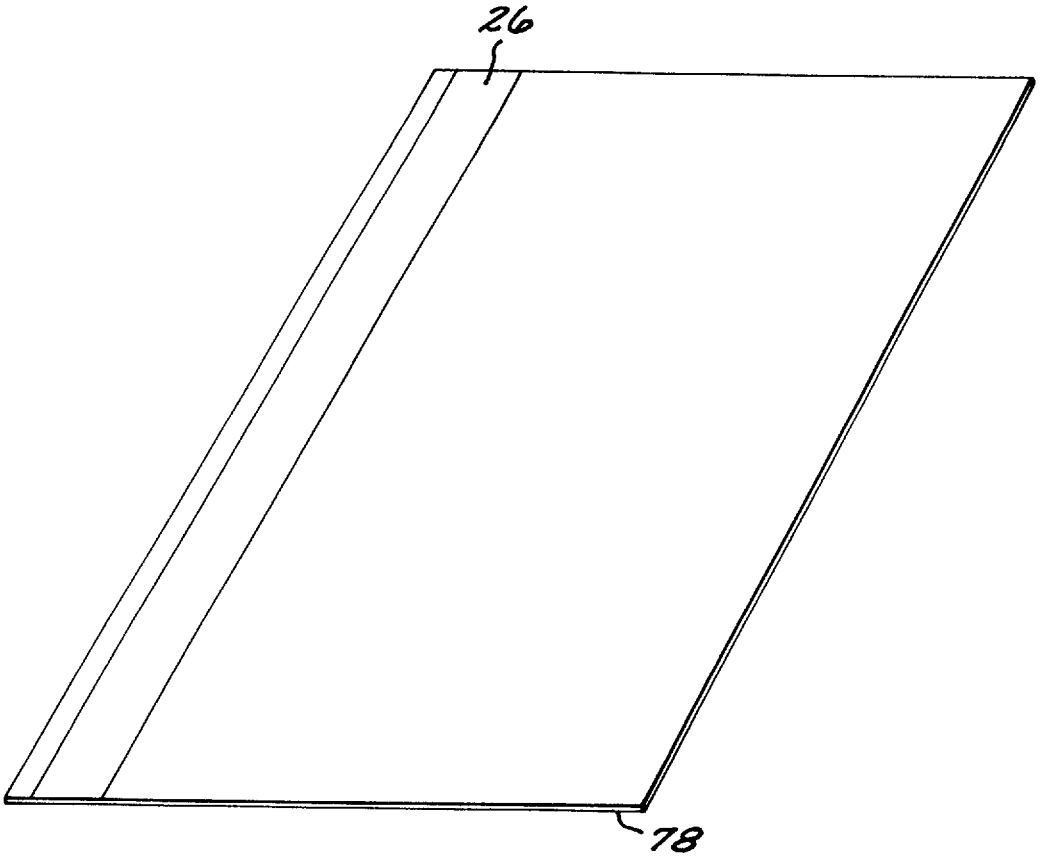
FIG. 18 is a perspective view of a sheet to which only one binding tape is attached.
Figure 19:
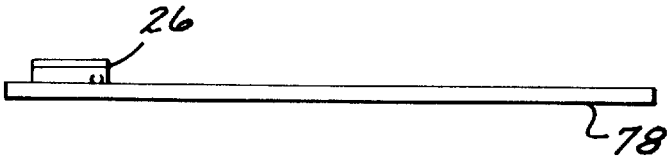
FIG. 19 is a cross-sectional view of FIG. 18 showing that the release adhesive is confined to the area under the binding tape.

FIG. 18 shows a sheet of paper similar to the tape sheet shown in FIG. 16 and FIG. 17 but differing in that the release adhesive is confined to a narrow stripe approximately the width of the narrowest tape. A single flattened tape may be placed, glue side down, on the narrow strip of release adhesive to which it will adhere as shown in cross-section in FIG. 19. The combination may now be passed through a printer. Since no adhesive is exposed, it will not adhere to the printer paper transport mechanism. After striping the tape off the sheet of paper, it may be reused a number of times until the adhesive no longer adheres to the binding tape.

The spine printing process uses precut tapes having thermal glue on one side. These tapes are relatively thin and flexible so that they can follow the path through a modern desk top printer. To insure that the tapes will pass through the printer, they are attached to an ordinary sheet of bond paper. The tapes are attached with a commercially available release adhesive. The sheet of paper should be longer than the tapes to insure proper feeding; thus for 11 inch long tapes, legal size bond paper should be utilized.

The tapes have a right angle bend, as set forth hereinabove, which must be unbent so that the tapes are flat before printing. After printing, the right angle bend must be restored before use in the book binding system of the present invention (it should be noted that flat tapes can be used, the right angle bend thereafter being added to the tapes).

The first step of the printing step is to print, on the oversize paper, the pattern which will be later printed on the tapes for alignment purposes. The tapes are then attached to the paper in the exact position over the pattern the tapes will receive. The paper, with tapes attached, is then fed through the printer a second time. This time, the identical printing occurs on the tapes instead of on the paper.

The binding tapes are preferably printed using color or black and white ink jet printers, or similar devices. Laser printers have a toner fusing step which can melt the glue on the binding tape, melted glue possibly contaminating the printer and thus this type printer should not be utilized.

A very simple black and white spine message or one with multiple colors, borders, background patterns, images, and logo's can be created. Any software program that can create the pattern to be printed on the tape can be utilized. The pattern is printed on the paper, the tapes are then attached to the paper, then attach the tape(s) and the print command is repeated.

An example of printing templates is set forth hereinafter using Microsoft's EXCEL software (Excel is a trademark of Microsoft Corporation, Redmond, Wash. Almost any application software will suffice to make a printable pattern.

The example demonstrates EXCEL being used to make a template for "A" size tape which is 15/16 inch wide and 11 inches long. Initially, a new workbook is opened.

1. Open the File menu and select the Page Set-Up option. Select the Page tab, select Landscape orientation, select Options, and select US Legal media size. Select the Margins tab activate the Vertically button in the Center on Page option. Press OK to return to the workbook.
2. Select Rows 1 through 6 (six rows are typically printed on the paper). Open the Format menu, select the Row Height option, and set the row height to 72. This will produce a row just slightly wider than 5/16 inch "A" size tape when printed. For "B" size tape use 94; for "C" size tape use 116; and for "D" size tape use 138.
3. Open the Format menu, select the Column Width option, and set the column width to 123. This will produce a row just slightly longer than 11.7 (A4 size tape) inches when printed. For 8.5 inch tapes use 92 and print on letter size paper.
4. Open the View menu and select the Toolbars option, activate the Formatting tool bar, and select the BORDER button. Use the format which places a border around each of the individual six cells.
5. Open the File menu and select Print Preview option. This shows the outline where six tapes would be positioned on legal size paper. Note that there is a significant margin on the left hand edge. This is the edge which will be fed first into the printer and is necessary to insure that the paper will feed properly on the second pass after the tapes have been attached. Press Close.
6. At this point the contents of the cell outline may be established in several ways. A text title may be added to the book in black or in color—for "Word Art" select Object under the Insert menu. With Word Art individual letters can be rotated so that the title will read vertically rather than from the side of the book. A halftone pattern and/or add a color may be added to match a cover color—select Cells under the Format menu. A border or a logo may be added, an image imported, etc.
7. When satisfied with the pattern, the page is printed on legal size paper. An exact copy of the pattern which will be laid down on the tapes during the second pass is printed. If it is preferred not to print the outline of each cell border, deselect the border pattern. Then open the page Set-up menu, select the Sheet tab, and deselect the Gridlines option within the Print window.
8. Normally the tapes are manufactured with a right angle corner built in to them. The tapes must be flattened to pass through the printer properly. They may be flattened by hand. Alternately, tapes are commercially available which are flat without the right angle bend. After printing, the tapes must be rebent with the right angle corner along the line score in the glue in order to be aligned properly in the book binding system of the present invention.
9. The flattened tapes are attached directly over the pattern they are to receive. An easy release adhesive should be used (a silicone based adhesive is not recommended as this may inhibit the thermal glue during binding). The leading edge of the tape should be secured to avoid catching during feeding through the printer. The rest of the tape requires only spot adhesive to hold it down to avoid catching on the print head (a minimum amount of adhesive should be utilized).
10. The sheet with tapes attached thereon is then fed through the printer to produce the second printing. After the tapes are printed, the tapes are removed slowly and carefully from the paper. The right angle in the tape along the score line in the glue is rebent and the preprinted tape is then used to bind the book in the manner set forth hereinabove.

Figure 34:
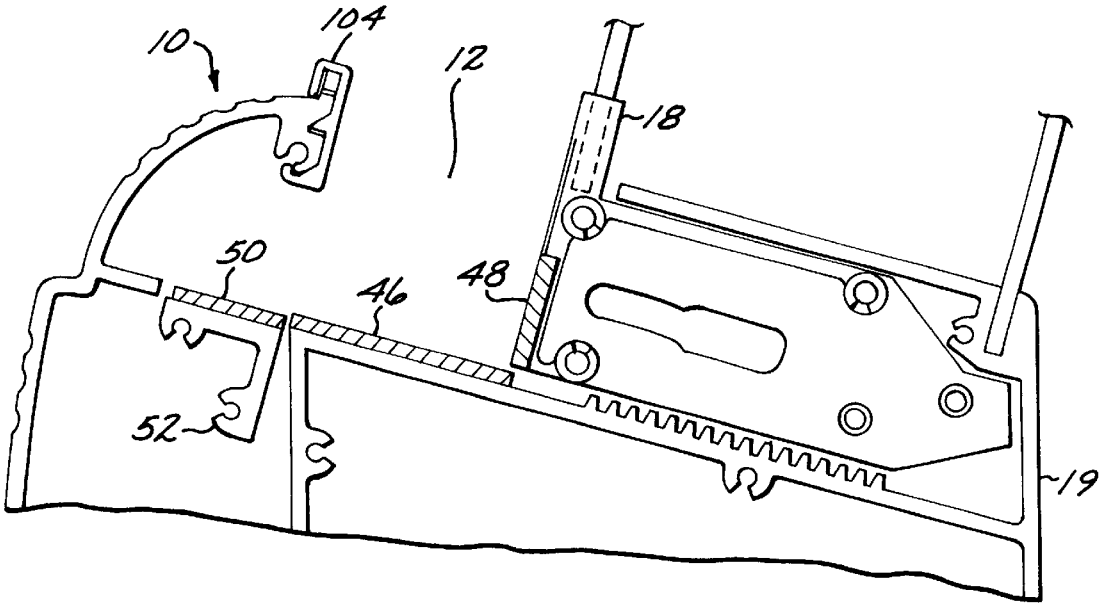
FIG. 34 is a simplified sectional view illustrating certain components of the apparatus of the present invention.

First referring to FIG. 34 is a cross-sectional view of apparatus 10 showing the primary elements which run the length of the book necessary for binding the book by applying a heat activated glue or binding tape is illustrated. The binding apparatus 10 comprises cavity 12 into which the binding tape and sheets to be bound are inserted. Within the binding cavity 12 are three heaters 46, 48 and 50 which apply heat to the three sides of the binding tape in the proper sequence and at the appropriate temperature. Heater 46, referred to as the spine heater, is attached to the frame 19, is stationary. Platen 18 and jaw 104 are employed in clamping the book and forcing it downward against the spine heater 46. Both platen 18 and jaw 104 are provided with a high friction surface to grip the outside covers of the book being bound providing a good mechanical bond between these elements and the book. Another heater 48 is attached to platen 18 and is used to bond the one edge of the binding tape along the edge of the front cover of the book being bound. A third heater 50 is attached to the bender 52. Bender 52 is held in the position shown while loading the book, clamping cycle and part way through the heating cycle. During the heating cycle when the glue is hot and pliable, bender 52 is actuated and the binding tape is then wrapped around the back edge of the book being bound. Compressor bar 57 is held in place during the loading of the document and is later pivoted out of the way when bender 52 is actuated exposing the back edge of the book to heater 50. The purpose of compressor bar 57 is to hold the edge of the pages into the corner so they do not fan out into the region of the subsequent arc of rotation of bender 52.

The following discussion and description of component mechanisms describes how and when these primary elements, which run along the length of the book, are employed in binding a book of varying thickness using a heat activated right-angled binding tape.

Figure 20:
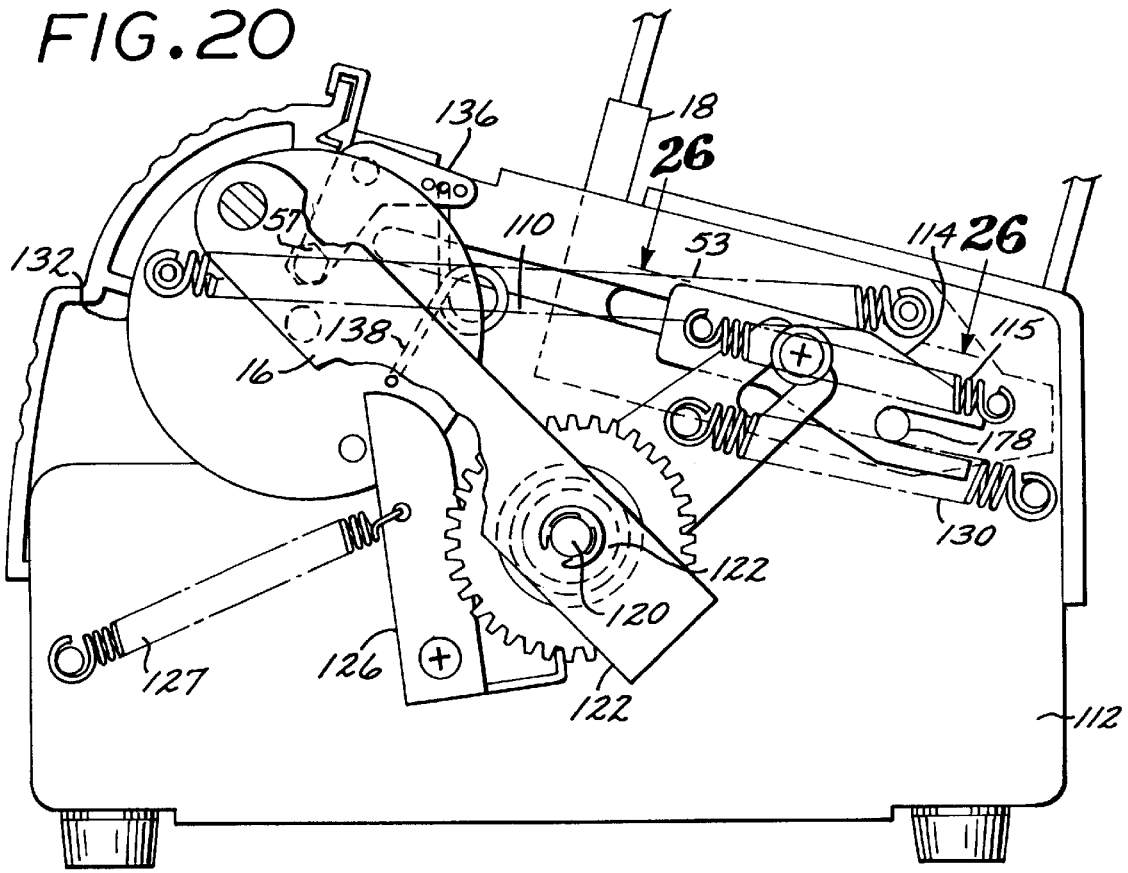
FIG. 20 illustrates the right side, if facing the apparatus, of the start or finished position.

FIG. 20 shows the mechanisms on the right end of apparatus 10 and how they are linked and connected together to the primary elements described above. Platen 18 is caused to slide to the left along guide 110 in the right end plate 112 parallel to the spine heater 46 by means of pin attached to the platen driver 114. The platen driver 114 is attached to the platen 18 by means of the clamp spring 115. Cylindrical pin 116 on the platen driver 114 passes through a clevis in the crank handle 16. The handle 16 has a hex hole and is attached to the hex clamp shaft 120 preventing relative rotation between these elements. The clamp shaft 120 extends the length of the apparatus from the right to the left end. A lock gear 122 with a one way roller clutch 124 pressed into its hub is applied to clamp shaft 120. Clutch 124 rides on a cylindrical portion of the clamp shaft 120 and prevents lock gear 122 from turning relative to the clamp shaft 120 in the counter clockwise direction. Lock gear 122 is held stationary relative to the right end plate 112 by means of open latch 126. Open latch 126 is also pivoted on a pin attached to the right end plate 112.

When handle 16 is manually pressed down, the rotation of this element counter clockwise induces a translation motion in platen 18 thereby closing the binder cavity 12. Lock gear 122 is rotating clockwise relative to handle 16 during this operation. A return spring 130 is attached to handle 16. The other end of the return spring 130 is attached to right end plate 112. Return spring 130 is provided to return handle 16 to binding cavity 12 open position. Open latch 126, connected to spring 127, engages latch gear 122, preventing clockwise rotation of handle 16. Bender 52 with heater 50, is connected to the right bender pivot 132. Bender spring 134 is attached to pivot 132. The other end of spring 134 is attached to right end plate 112. Right bender pivot 132 is linked to compressor crank 136 by means of the right compressor link 138. The compressor bar 57 is attached to the compressor crank 136. Both the compressor crank 136 and the right bender pivot 132 are mounted to a pivot pin on the right end plate 112. The right end plate 112 is fastened to the frame 18 which extends the length of the machine from right to left end.

Figure 21:
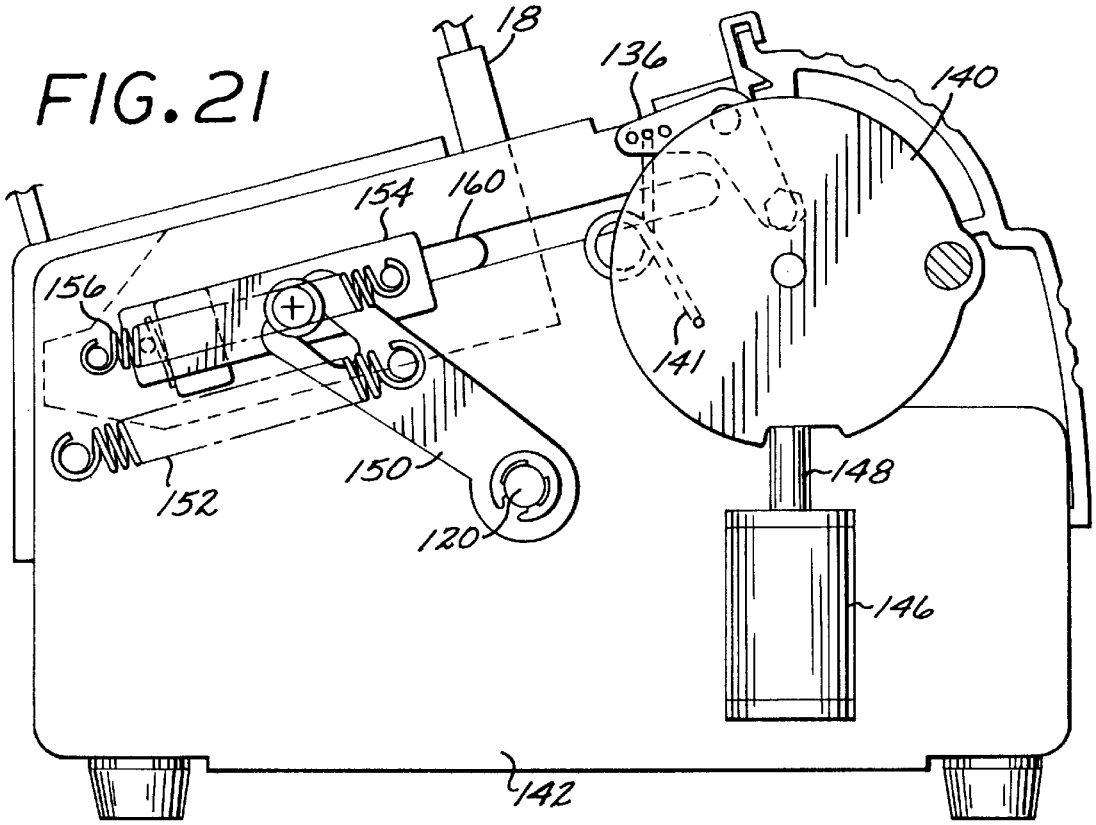
FIG. 21 illustrates the left hand side of the start or finished position.

FIG. 21 shows the mechanisms on the left end of apparatus 10 and how they are linked and connected together to the primary elements described above which contact the book. The left bender pivot 140 is similar in function to the right bender pivot 132 described above. The left bender pivot 140 is also fastened to the bender 52 and is pivoted around a pin connected to the left end plate 142. The left bender pivot 140 is linked to the compressor crank 136 by means of the left compressor link 141. The compressor bar 57 is attached to the compressor crank 136. A solenoid 146 is mounted on the left end plate 142 and its plunger 148 is caused to intersect a cutout in the left bender pivot 140.

With the solenoid 146 in the off position, the plunger 148 prevents the left bender pivot 140 from rotating counterclockwise. When the solenoid 146 is activated momentarily, the bender spring 53 causes the bender 52 to rotate around the corner of the document being bound.

Attached to this end of the clamp shaft 120 is left clamp clevis 150 which is keyed to the clamp shaft 120 using a hex hole. As the clamp shaft 120 rotates with the motion of the handle 16, the left clamp clevis 150 also rotates driving the platen 18 forward closing the binding cavity 12. On this end of the apparatus is provided return spring 152, platen driver 154, clamp spring 156, guide 160, link 162 and compressor crank 164.

Figure 22:
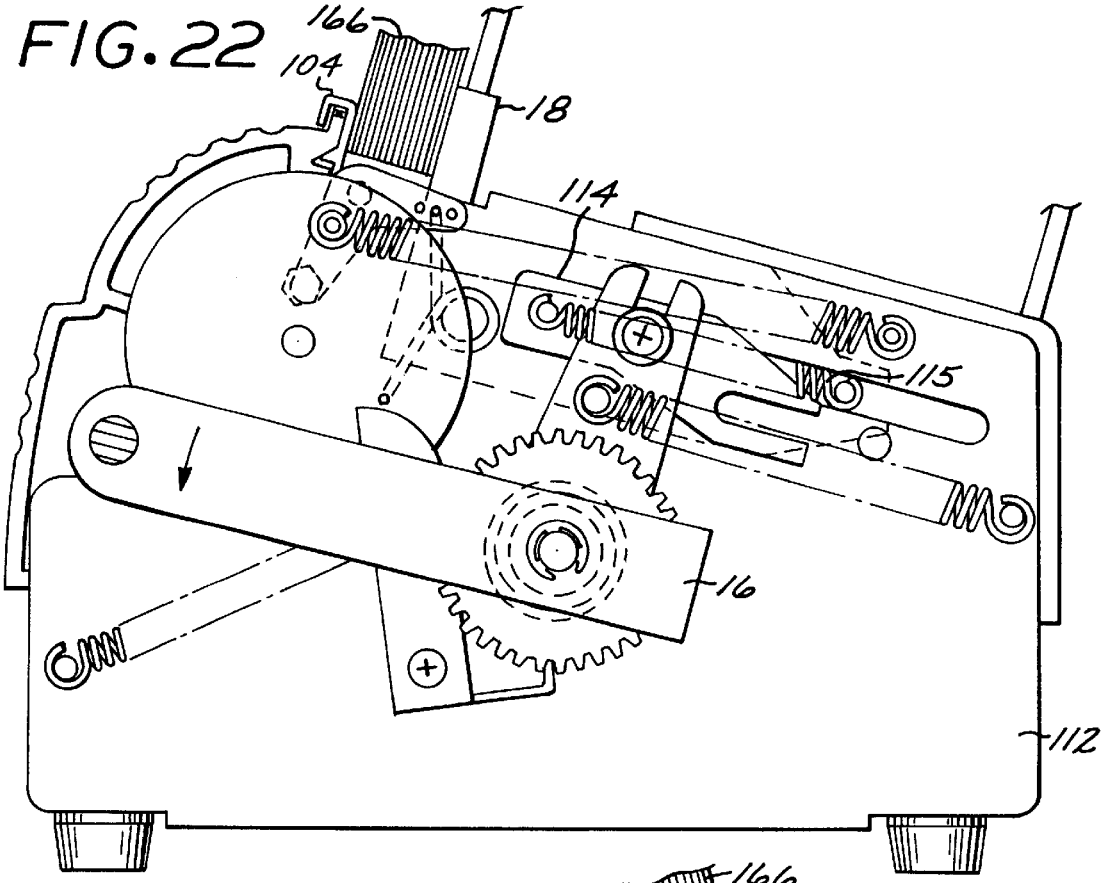
FIG. 22 illustrates the right hand handle moved down to clamp the paper.
Figure 27:
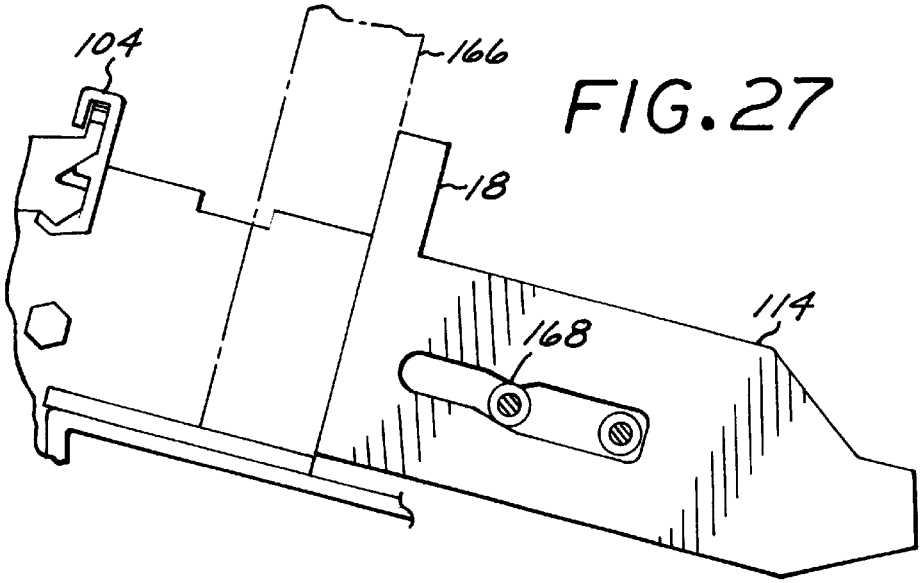
FIG. 27 illustrates sheets of paper positioned in the apparatus.
Figure 28:
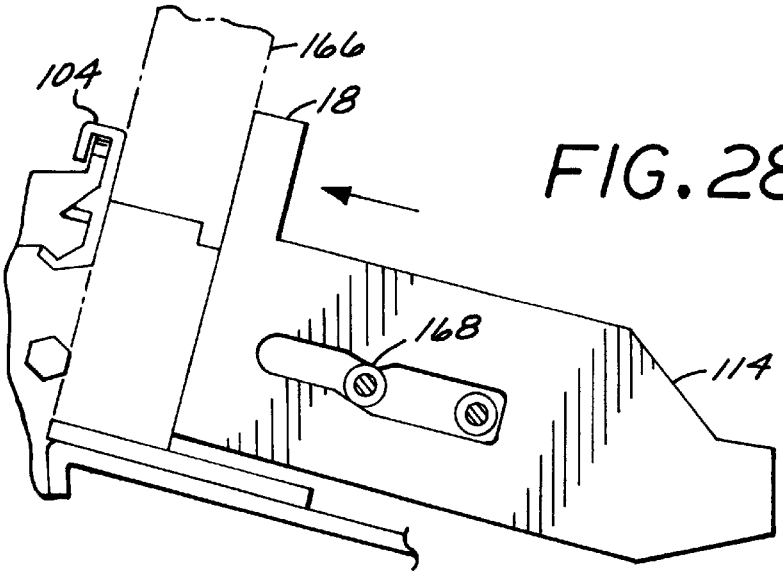
FIG. 28 illustrates the paper being clamped.
Figure 29:
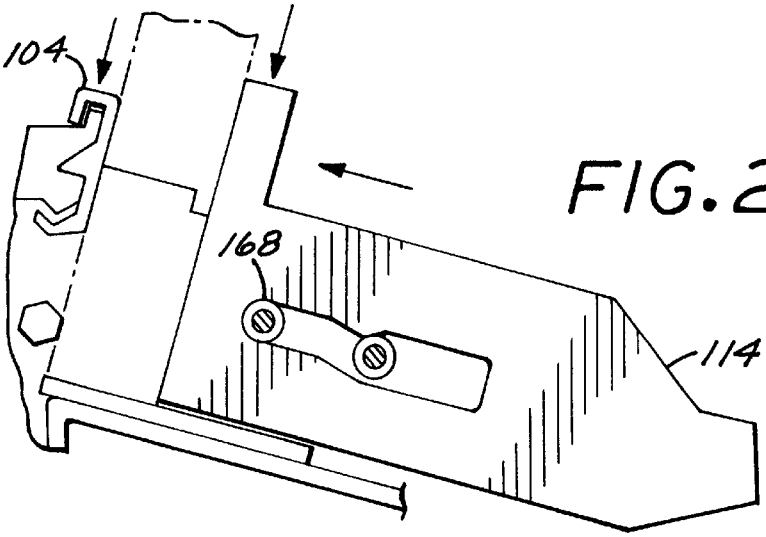
FIG. 29 illustrates the paper clamped and pressed downwardly.

FIG. 22 illustrates the binding apparatus 10 with a book 166 inserted into the binding cavity 12. The handle 16 is rotated counter clockwise driving the platen 18 forward to contact the book 166. The platen driver 114 slides relative to the platen 18 stretching the clamp springs (116,156) on both ends of the platen 18 pushing the platen 18 forward against the book 166 and causing it to be gripped between the jaw 104 and the face of the platen 18. Platen drivers 114, while moving relative to the platen 18, are being guided in a cam 168 (FIGS. 27, 28 and 29) on the ends of the platen 18 which causes the platen to pivot its front edge downward displacing the front of the book 166 down against the spine heater 46. At the point of contact with the book 166, the jaw 104 is also caused to slide relative to a beveled mounting surface between it and the frame 19 which it mounts. The result is that the back surface of the book 166 being in contact with the jaw 104 is also displaced downward against the spine heater 46.

Figure 23:
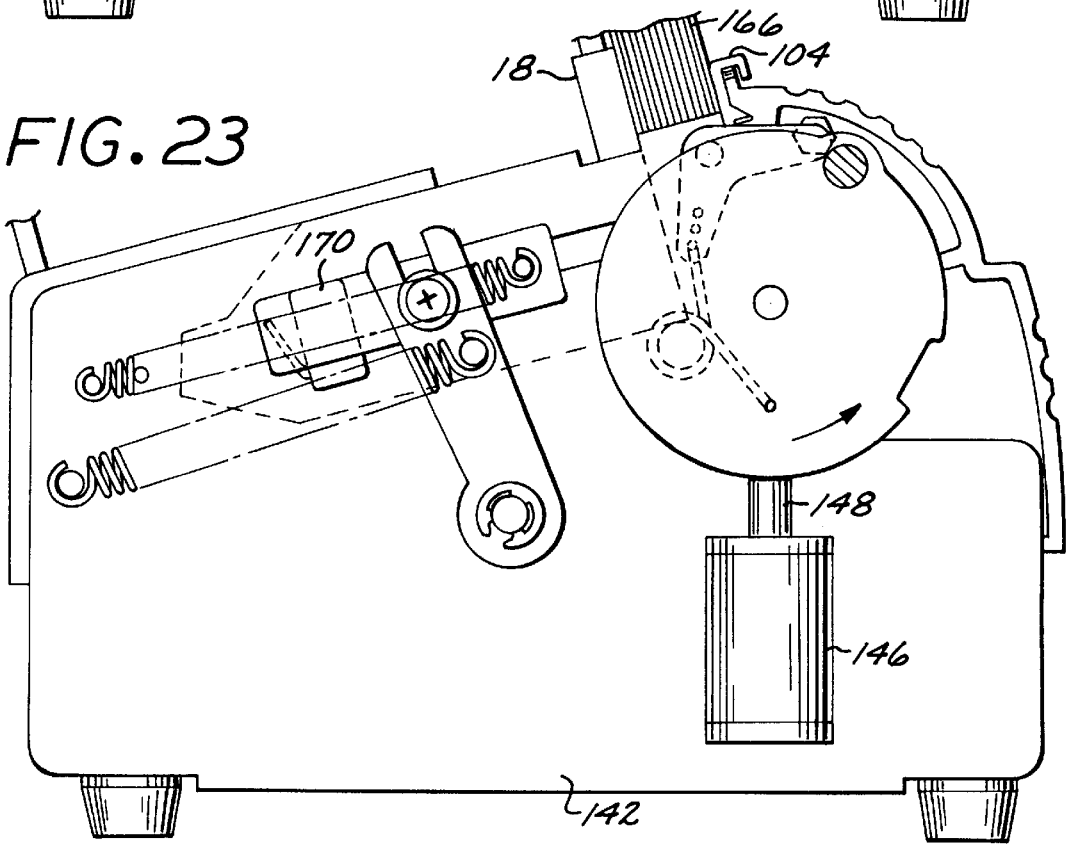
FIG. 23 illustrates the left hand side in the paper clamping position.

A switch 170 (FIG. 23) is mounted in such a way as to sense the displacement between the platen driver 114 and the platen 18 and turns on the power to the controller circuit (FIG. 35) when the book 166 is compressed between the platen 18 and the jaw 104 described above. At this point in the binding cycle, the operator will note that the process has begun by the presence of a blinking of the LED 22 on the left end of apparatus 10 accompanied also by an audio beeping of the buzzer on the controller board. The operator would then release the handle 16.

Upon release of the handle 16, the return springs 130 and 152 on both ends of apparatus 10 will attempt to pull the platen 18 back. However, the open latch 126, engaged with the lock gear 122, will prevent rotation in this direction. These conditions being true, the binding process will proceed unassisted by the operator until it is completed.

The sequence of events during the binding process when the electrical power is turned on is as follows:

1. Voltage levels and frequency of the incoming alternating power is measured and the power profile and timing to the heaters is established.
2. The LED 22 is turned on and caused to blink.
3. The buzzer is turned on for a short time indicating that the process has begun and then it is turned off.
4. All three heaters 46, 48 and 50 are then turned on and the temperature is measured indirectly during each cycle of the alternating current and compared with preset calibration limits set on the controller board. The platen heater 48 and the bender heater 50 are the first to come up to temperature and their temperature is maintained by the controller circuit. When the spine heater 46 reaches its preset temperature level the solenoid 146 is energized, releasing the bender heater 50 to bend the excess binding tape around the back edge of the book 166.
5. All three heaters are then turned on for a preset period of time to finish the heating cycle.
6. After the heating cycle is completed all heaters are turned off and the LED is turned on continuously during the cool down cycle indicating that the heat cycle is finished.
7. After the cool down cycle, the LED is turned off, the cycle counter is incremented by one and the buzzer is sounded for several times to indicate the book is bound.

Following the binding cycle, the operator will need to remove the book 166 from the apparatus.

Figure 24:
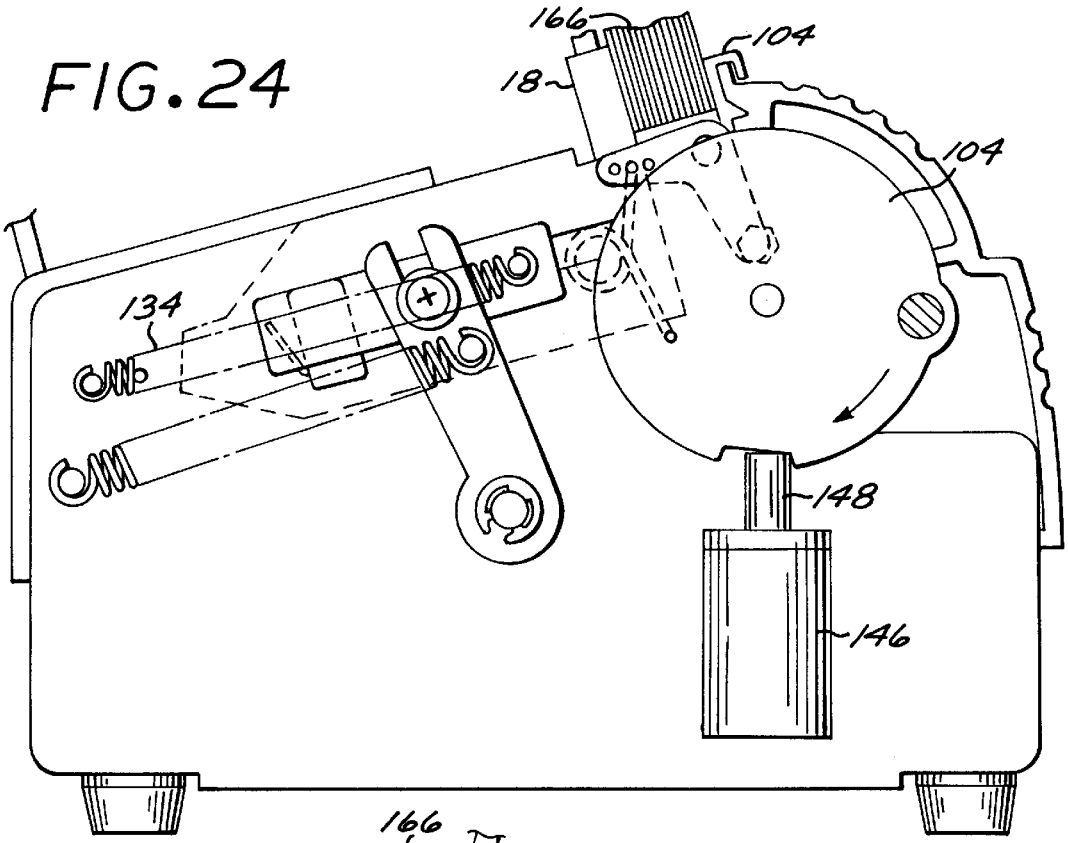
FIG. 24 illustrates the right hand side with the wheel turned back to reset and release the gear.
Figure 25:
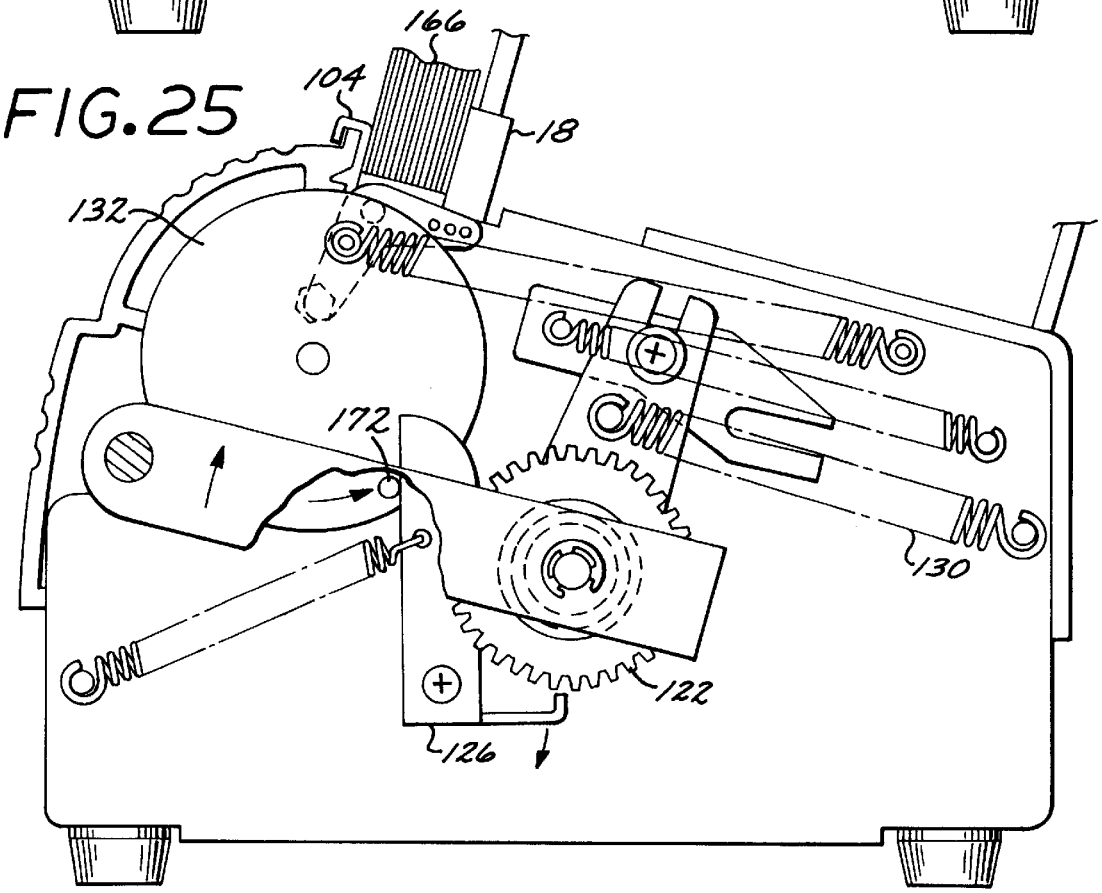
FIG. 25 illustrates the gear released with the system returned to its start position.

FIG. 24 illustrates the process for opening the binding cavity 12 to remove the book 166 from the apparatus after the binding process is completed. Handle 24 (not shown in the figure) is attached to left bender pivot 140 which is employed after the binding cycle is completed or to open the machine at any time. When this handle is depressed the left bender pivot 140 and bender 52 are rotated around the corner of the book 166 resetting the bender spring 134 and re-engaging the solenoid plunger 148 into the left bender pivot 140. Further motion in the same direction will bring the release pin 172 on left bender pivot 140 (FIG. 25), into contact with the open latch 126 causing it to disengage the lock gear 122. The platen 18 at this point is drawn open by the force of the return springs 130 and 152. Having opened the binding cavity 12 and all mechanisms reset to the start condition, the book 166 can be removed and a new document bind cycle begun.

Figure 26:
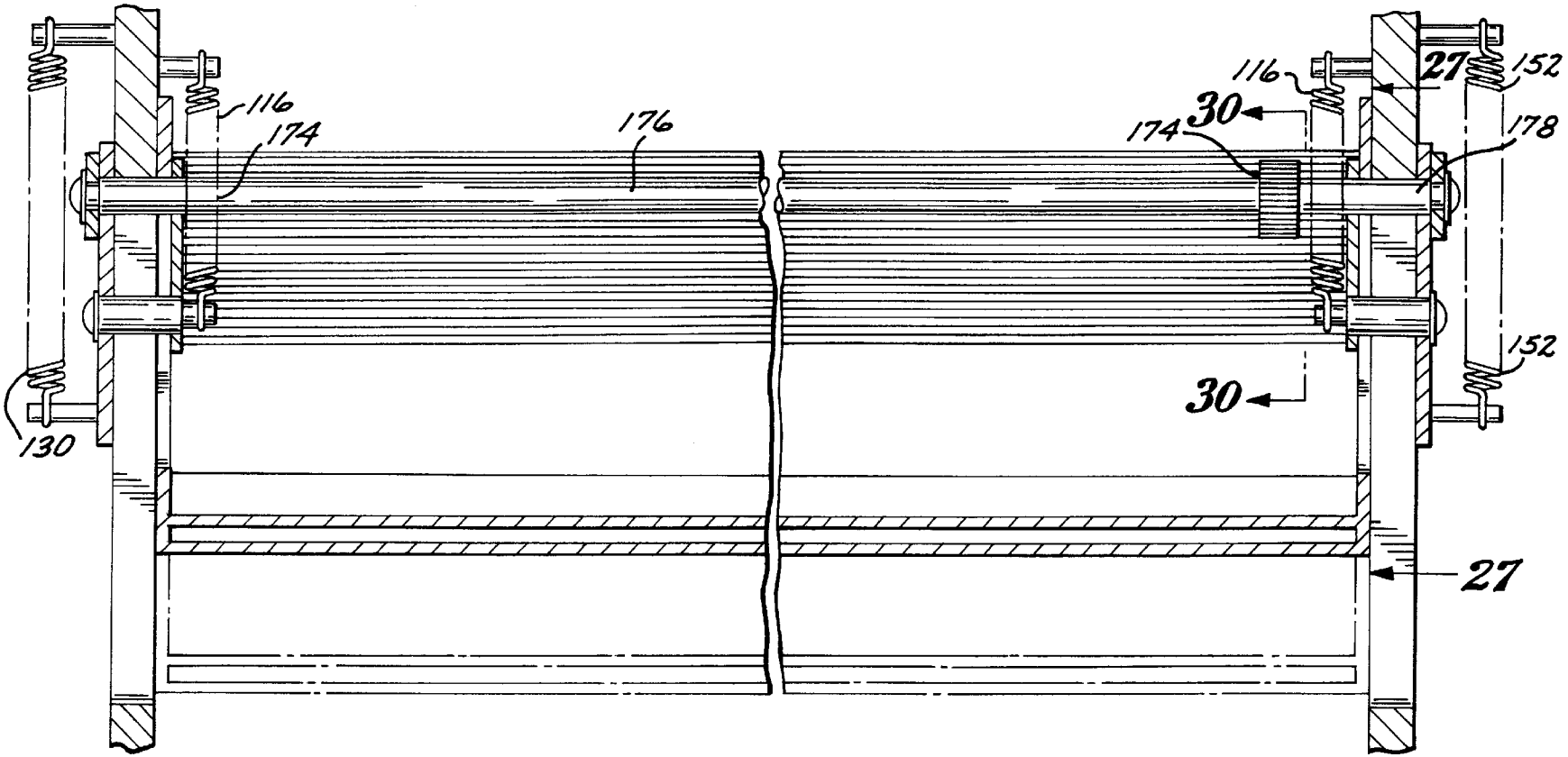
FIG. 26 is a cross-sectional view illustrating how both sides of the apparatus move together.

FIG. 26 illustrates the function of the gears 174 which are connected together and keyed to a tube 176. The gears 174 rotate on a pin 178 (FIG. 20), attached to the platen 18 at both ends. The teeth of the gears 174 engage a rack 180 (FIG. 30), of the gear teeth that are formed on the frame 19. As the platen 18 moves forward to contact a book 166 narrower than the length of the binding cavity 12, the gears 174 and rack 180 will keep the platen 18 in alignment with the book 166 if the book is offset to one side thus providing lateral stability of platen 18.

Figure 30:
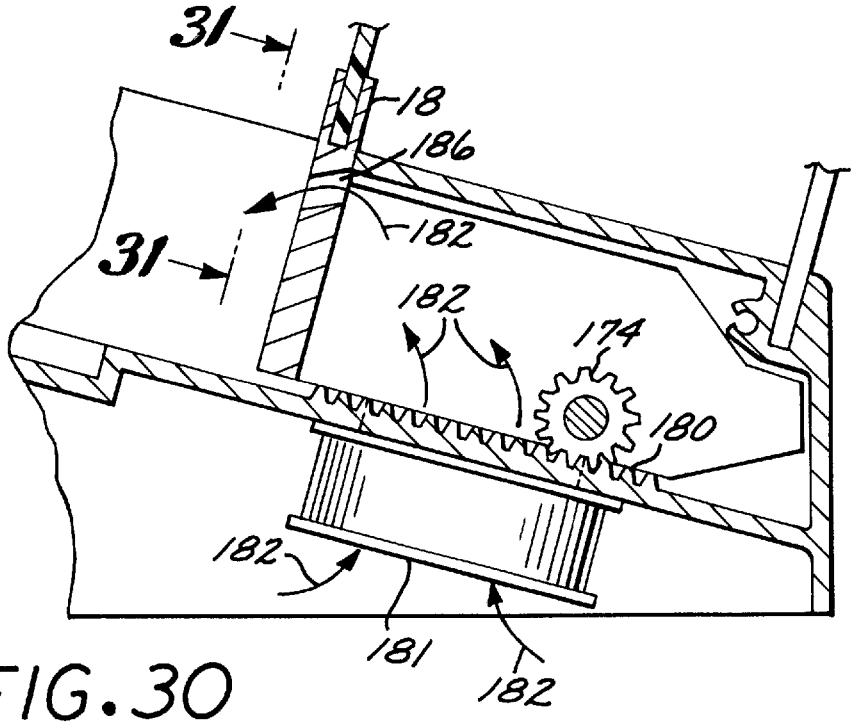
FIG. 30 illustrates the fan to cool the heater.
Figure 31:
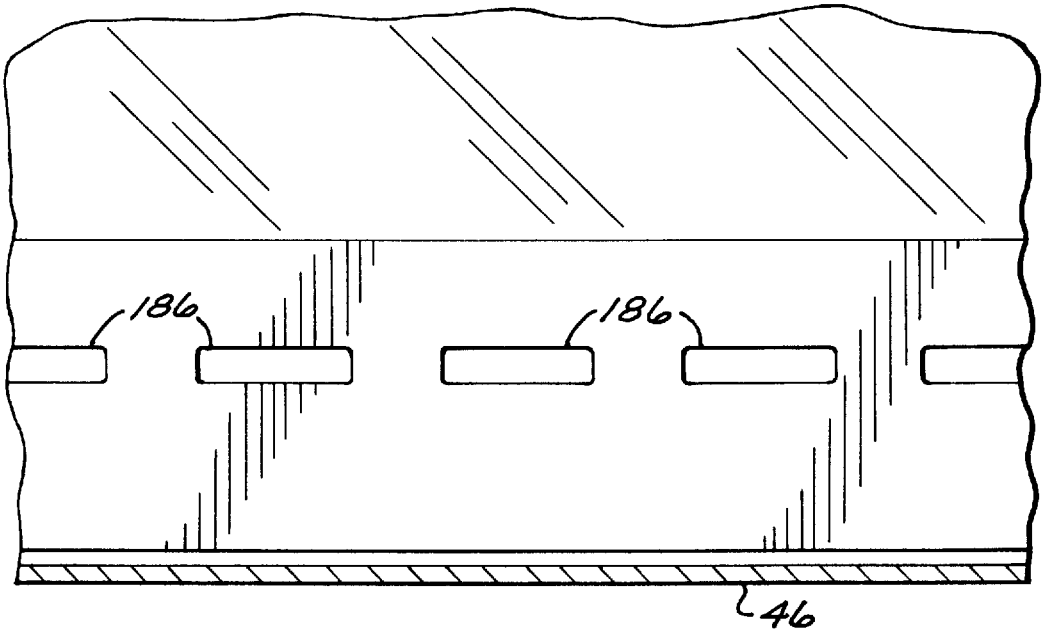
FIG. 31 is a sectional view along line 31—31 of FIG. 30.

Referring to FIG. 30 and 31, a fan 181 is provided to cool heaters 46, 48 and 50 which are not in contact with a book 166. Since the books 166 to be bound may vary in size and length, a portion of the heaters are usually not in contact to the thermal mass of the book 166. In this situation the heaters, being of relatively small thermal mass, can overheat in the areas that are not in contact with the book 166. The fan 181 is employed to circulate and direct air indicated by arrows 182 onto the exposed areas of the heaters by means of vents 186 which are positioned along the clamping surface of the platen 18. Vents 186 are covered by the book 166 and exposed at the point where the book 166 ends thereby allowing the air 182 to flow out of the vents 186 where needed to cool the exposed areas of the heaters.

Figure 32:
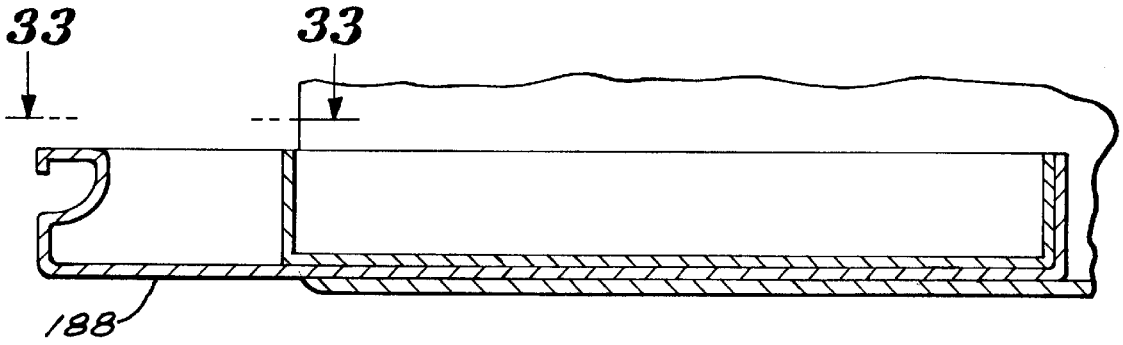
FIG. 32 illustrates the storage tray portion of the apparatus of the present invention.
Figure 33:
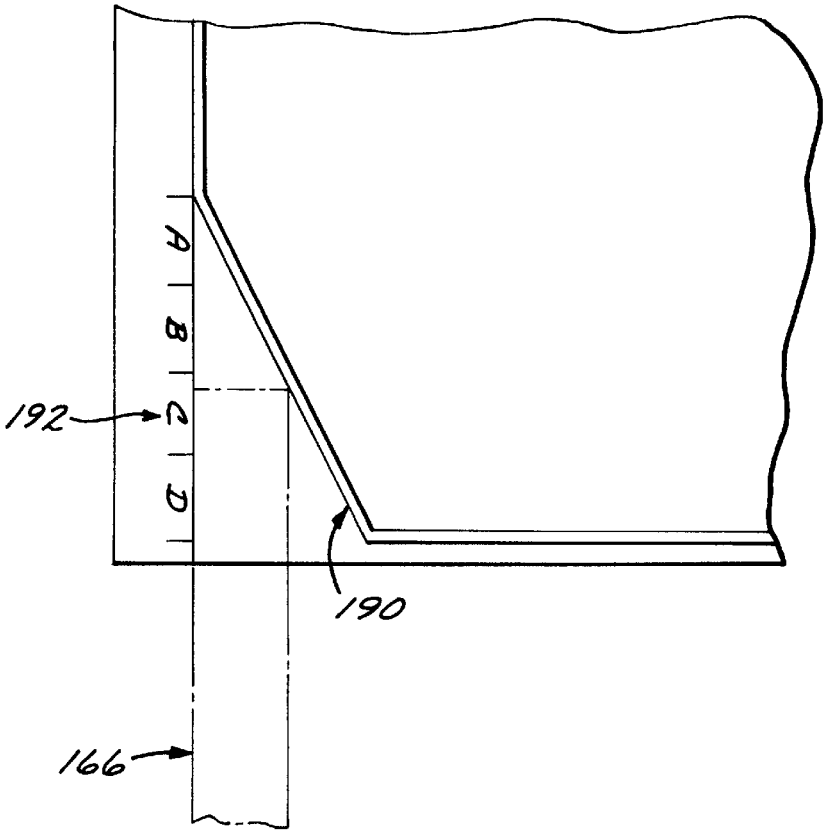
FIG. 33 is a view along line 33—33 of FIG. 32.

Referring now to FIGS. 32 and 33, a drawer 188 is provided to serve two functions. The primary function is to store binding tapes in a convenient location under apparatus 10. Included in the drawer 188 is a wedge 190 and scale 192. The book 166 may be inserted into the wedge 190 to determine the size of the binding tape to use indicated by the scale 192. This is possible since four size thickness's of tapes (A, B, C & D) are used to cover the range of documents from three-pages (size A) to 300-pages (size D).

Figure 35:
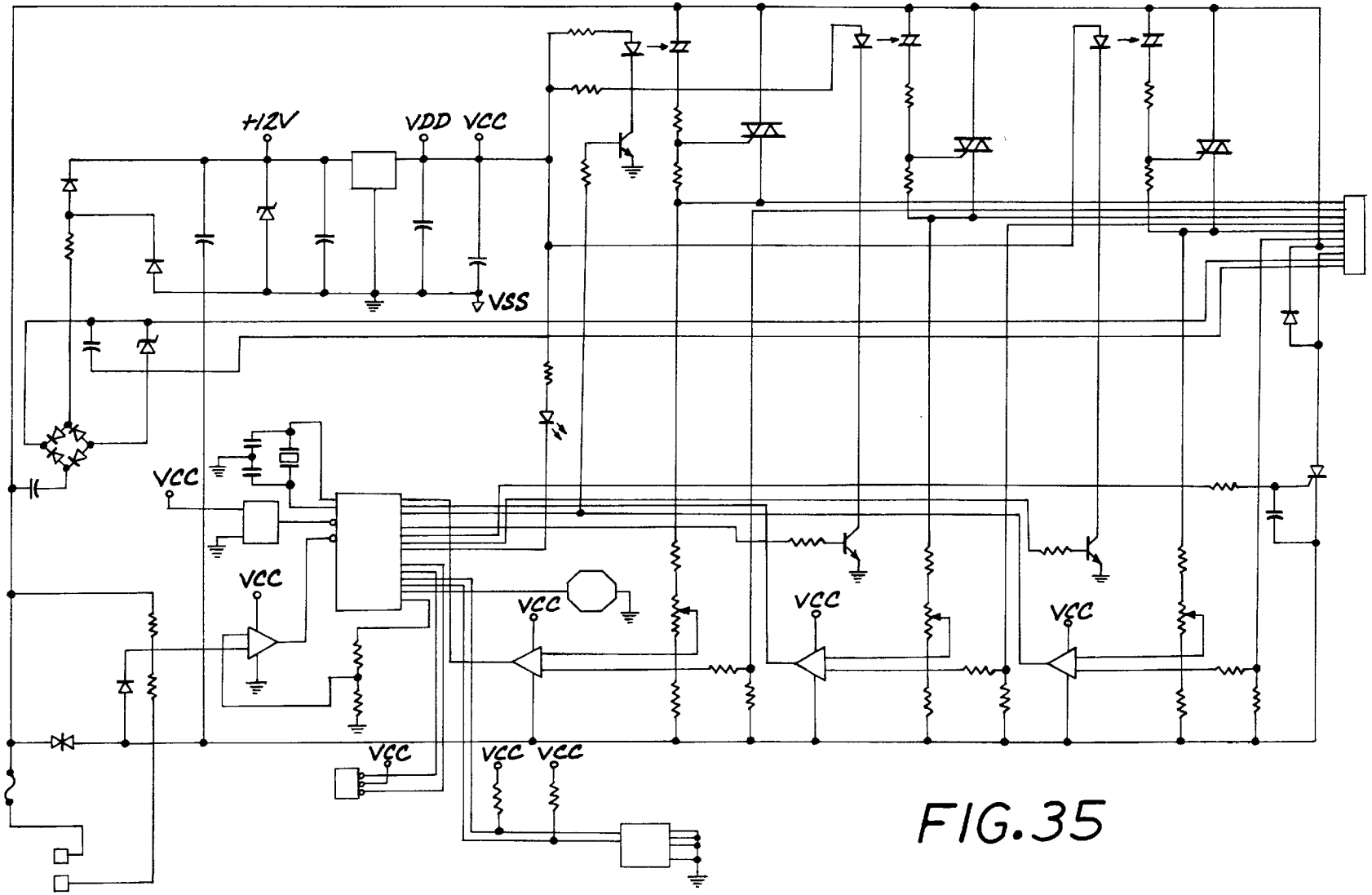
FIG. 35 is a schematic diagram of the controller used in the binder apparatus of the present invention.

The circuit schematic for the controller used in apparatus 10 is shown in FIG. 35 and comprises three microprocessor controlled thermostats that control the temperature of three strip heaters 46, 48 and 50.

The power of the platen heater 48 is controlled by triac Q4. Because Q4 is a highside switch, the control signal is level shifted by optoisolator ISO1, which is turned on from the microprocessor U2 (Motorola Model No. MC68HC705J1A) by transistor Q1. This same control circuit is replicated for the bender heater 50 with elements Q5, ISO2, and Q2 and for the spine heater 46 with elements Q6, ISO3 and Q3.

The feed back for the microprocessors temperature control algorithm is done by measuring the current going through each strip heater. The heaters are manufactured with an alloy that has a positive resistive temperature coefficient so that the current decreases as the temperature rises. The current in each heater is sensed by R32, R21 and R29 respectively. This current is compared against an adjustable reference (R13, R25 and R30) by comparators U3A, U3C and U3D to indicate if the temperature is above or below the set temperature. Their signals are feed to the microprocessor U2 to complete the control loop. The temperature can only be measured accurately when the heater is turned on and the power line voltage is at the peak of the positive half sine wave cycle. The microprocessor determines the voltage peak by first determining when zero-crossing occurs with comparator U3B and delaying an appropriate amount of time.

When a binding cycle begins, each heater begins heating to the set temperature established for that heater and the temperature of the two side heaters is regulated at the current level until the spine heater 46 reaches its preset temperature. At this time, the microprocessor U2 turns on SCR Q7 briefly to release the bender latch. After the solenoid is activated, all three heaters are turned on unregulated for a short period of time and then all heaters are turned off.

While the heaters are on, LED 22 via D1 is caused to flash. After all heaters are turned off, the LED is turned on continuously for a cool down period. After the cool down period a usage counter stored in non-volatile memory U6 is incremented by the microprocessor. Piezoelectric buzzer Y2 is next sounded to indicate the binding cycle is complete after which all power is turned off.

The present invention thus provides a bender apparatus which is less expensive than binder devices currently available and binder tapes which are specifically configured to be utilized with the apparatus. Conventional desk top computers and ink jet printers can be utilized to print various legends on the binder tapes prior to the binding operation; the number of printed spines being determined only by the requirements of the user and not specifically by cost considerations.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

What is claimed is:

1. A binder apparatus for binding together a stack of sheets of a predetermined thickness, each sheet of said stack having a front edge portion, said stack having a first sheet having a first surface and a second sheet having a first surface comprising:

a housing;

a binding tape having first and second surfaces extending in a first direction, a layer of adhesive formed on said first surface of said binding strip, said tape being bent along a score line formed formed in said adhesive layer to form a member having first and second leg portions said first leg portion being substantially perpendicular to said second leg portion;

a cavity in said housing into which said binding tape is inserted, a corner being located at the bottom of said cavity against which said second leg portion of said binding tape is aligned, said sheets being positioned in said slot so that substantially all of the edges thereof are in contact with said surface of said leg portion of said binding tape, a portion of said first leg portion of said binding tape extending beyond the thickness of said stack;

a movable platen to clamp and hold said binding tape and sheets against a stop member;

heater means for softening said adhesive;

a member for bending the extending portion of said first leg portion of said binding tape against a portion of the first surface of said second sheet in said stack;

first means for controlling the amount of heat supplied by said heater means and the length of time said heater is energized; and second means for activating said bending member.

2. A binder apparatus for binding together first and second covers comprising;

a housing;

a binding tape having first and second surfaces extending in a first direction, a layer of adhesive formed on said first surface of said binding tape, said tape being bent along a score line formed in said adhesive layer to form a member having first and second leg portions, said first leg portion being substantially perpendicular to said second leg portion;

a cavity in said housing into which said binding tape is inserted, a corner being located at the bottom of said cavity against which said second leg portion of said binding tape is aligned, said first and second covers being positioned in said cavity so that the edges thereof are in contact with said surface of said first leg portion of said binding tape, a portion of said first leg portion of said binding tape extending beyond the thickness of said covers;

a movable platen to clamp and hold said binding tape and said first and second covers against a stop member;

heater means for softening said adhesive;

a member for bending the extending portion of said first leg portion of said binding tape against a portion of a surface of said first cover;

first means for controlling the amount of heat supplied by said heater means and the length of time said heater is energized; and second means for activating said bending member.

3. A method of binding a stack of sheets, said stack having a first surface, a second surface and an edge portion comprising the steps of:

providing a substantially planar shaped binding tape having first and second surfaces, an adhesive layer being formed on the first surface of said binding tape;

folding said binding tape such that said binding tape is formed into a configuration having first and second leg portions, said first leg portion being substantially perpendicular to said second leg portion;

inserting said folded binding tape into a cavity formed in a binding apparatus;

positioning said stack of sheets such that the first surface of said stack is adjacent said first leg portion of said binding tape and said stack edge is positioned adjacent the second leg portion of said binding tape;

folding said second leg portion of said binding tape so that it is adjacent said second surface of said sheet stack; and heating said binding tape such that the sheets are bound together.

4. The method of claim 3 further including the step of forming a score line on said binding tape and bending the tape along said score line prior to inserting it into said cavity.

5. The method of claim 4 further including the step of providing a sheet of binding tapes, each binding tape arranged side by side, each binding tape comprising first and second surfaces and a layer of thermally softenable adhesive formed on said first surface thereof, a release sheet being releasably attached to said second surface of said binding tape.

6. The method of claim 5 wherein score lines are formed on the surface of said adhesive layer on each binding tape.

7. The method of claim 5 further including the step of feeding said binding tape sheet to a printer prior to insertion of a selected binding tape into said binding cavity.

8. The method of claim 7 further including the step of printing information on said selected binding tape prior to insertion into said cavity.

9. A method of making a binding tape to be used in the subsequent binding together of a stack of sheets comprising the steps of providing a binding tape member having first and second edges, said first edge being substantially perpendicular to said second edge and first and second surfaces, said first surface of said binding tape member having a layer of heat softenable adhesive formed thereon, providing a score line in said binding tape member substantially along the entire width of said binding tape member in a direction substantially perpendicular to the second edge of said binding tape member, and bending said binder tape member along said score line such that said binding tape member has first and second leg portions, said first leg portion being substantially perpendicular to said second leg portion to complete said binding tape to be used for a susequent binding of a stack of sheets therewithin.

10. The method of claim 9 further including the step of inserting said binding tape into a cavity whereby said first leg portion of said binding tape is positioned against an alignment corner within said cavity.

11. The method of claim 10 wherein the edges of said sheets forming said stack contact the first surface of said second leg portion, said second leg portion extending beyond the width of said stack of sheets.

12. The method of claim 11 wherein said stack has a first surface and further including the step of folding said extended leg portion against the first surface of said stack.

13. A method of binding together first and second covers comprising the steps of:

providing a binding tape having first and second surfaces extending in a first direction, a layer of adhesive formed on said first surface;

folding said binding tape along a score line formed in said adhesive layer to form a member having having first and second leg portions, said first leg portion being substantially perpendicular to said second leg portion;

inserting said binding tape into a cavity formed in a binding apparatus, a corner being located at the bottom of of said cavity against which said second leg portion of said binding tape is aligned, said first and second covers being positioned in said cavity so that the edges thereof are in contact with said surface of said first leg portion of said binding tape, a portion of said first leg portion of said binding tape extending beyond the thickness of said covers; and heating said binding tape such that said first and second covers are bound together.

14. The method of claim 13 wherein a shaped member having an adhesive resistant coating on at least a portion of its exterior surface is positioned between said first and second covers prior to the heating of said binding tape.

15. The apparatus as set forth in claim 2 wherein a shaped member having an adhesive resistant coating on at least a portion of its exterior surface is positioned between said first and second covers.

* * * * *